United States Patent [19]

Satoh et al.

[11] 4,130,184

[45] Dec. 19, 1978

[54] ELEVATOR SPEED CONTROL SYSTEM

[75] Inventors: Tsuyoshi Satoh; Kenzo Tachino, both of Inazawa, Japan

[73] Assignee: Mitsubishi Denki Kabushiki Kaisha, Tokyo, Japan

[21] Appl. No.: 799,314

[22] Filed: May 23, 1977

[30] Foreign Application Priority Data

May 27, 1976 [JP] Japan ..... 51-61595

[51] Int. Cl.[2] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,552,524 | 1/1971 | Benjamin et al. | 187/29 |
| 3,589,474 | 6/1971 | Waure | 187/29 |
| 3,670,851 | 6/1972 | Shima | 187/29 |
| 3,783,974 | 1/1974 | Gilbert et al. | 187/29 |
| 3,887,039 | 6/1975 | Boniek | 187/29 |

*Primary Examiner*—Robert K. Schaefer
*Assistant Examiner*—W. E. Duncanson, Jr.

[57] ABSTRACT

During the acceleration of an elevator car frequency modulated clock pulses are counted up by a first counter to generate a command speed pattern. A second counter similarly generates a second speed pattern identical in shape to and delayed a predetermined time relative to the command speed pattern. A randum access memory successively stores theoretical distances of movement of the car due to the command speed pattern suitably corrected and the second speed pattern as a distance-to-speed function. When and after both patterns first equal each other, a command deceleration pattern is generated to follow objectives or the distance-to-speed function. Once the command speed again equalled the objective, the intact distance-to-speed function is used as a command deceleration pattern concerning residual distances to a stop floor.

7 Claims, 19 Drawing Figures

SP
SX
92
94
86
SHIFT REG.
IN
Q
CLI 28
88
96
108
106'
ADD/SUB
80
M
S
A
B
C
Co
82
F.F.
D
T
Q
90
106
104
12
78
76
TM13
68
74
66
72
64
70
PUP
PDN
100
102
VCC
98b
98c
98
98a
60
PULSE GEN.
60b
62
DIR. PULSE GEN.
60a
10
TM30
M18
M22
M20
M14
M12
M10
M16
DRIV MOTOR
8F
3F
2F
1F

PC1
PC2
AEQ
18
30
RATE MULT.
A B C D E F
T
Y
216
COUNTER
A B C D
CU
CD
R1 R2
218
202
192
MAG. COM.
A=B
B3 B2 B1 B0
A3 A2 A1 A0
184
186
REV. COUNT.
CA
BR
L
188
DATA SELEC.
S
4A 3A 2A 1A 4B 3B 2B 1B
188d
188a
190d
190c
190b
190a
196
200
194
198
AR4
AR3
AR2
AR1
ST3
ST7
ST5
ST9

ELEVATOR SPEED CONTROL SYSTEM

BACKGROUND OF THE INVENTION

This invention relates to improvements in an elevator speed control system.

In elevator systems the elevator car is generally driven through both a mechanical system including an electric motor, a winding mechanism etc. and a rope system and controlled in speed by a speed control system. However, the car actually travels with a time delay relative to a speed pattern provided by the speed control system due to various external disturbances such as a loss occurring in the mechanical system, a time delay inherent to the control system, etc. In order to increase an accuracy with which elevator cars are to land at any desired position, elevator speed control systems generally generate the speed pattern on the basis of time during the acceleration and on the basis of a distance during the deceleration. The speed pattern during the deceleration temporally leads the actual travel of elevator cars and is only accommodated to a region in which the deceleration is effected with the particular acceleration remaining unchanged. In order to make a ride in an elevator car involved more comfortable at and adjacent to both a maximum and a landing speed thereof, an associated speed pattern can be rounded but it has been difficult to provide a speed pattern rendering the ride in the car comfortable in the basis of a precise distance in a speed region in which the speed pattern is rounded. This is because a logic circuitry for generating a speed pattern including turn around positions is too to be put practical use at present.

Accordingly it is an object of the present invention to provide a new and improved elevator speed control system substantially free from the disadvantages of the prior art practice as above described and providing a precise distance-to-speed pattern with a simplified circuit configuration and without the necessity of performing the complicated logic operation.

SUMMARY OF THE INVENTION

The present invention provides an elevator speed control system comprising, in combination, first speed pattern generator means for generating a command speed pattern, second speed pattern generator means for generating a second speed pattern delayed a predetermined time interval with respect to the command speed pattern during the acceleration, distance-of-movement calculating means for calculating theoretical distances of movement due to the command speed pattern, memory means for writing and reading the calculated theoretical distances of movement into and out from the same, the memory means storing the second speed pattern concerning the theoretical distances of movement in the form of a distance-to-speed function during the acceleration, and means for utilizing the second speed pattern stored in the memory means to generate a command deceleration pattern during the deceleration.

Preferably, at and after a time point where the second speed pattern is first equal to the command speed pattern, a command speed pattern may be generated while an acceleration is modified so that the last-mentioned command speed pattern follows up objectives of command speeds concerning residual distances to an objective position, the objectives of command speeds being provided by the distance-to-speed function stored in the memory means during the acceleration, and once the command speeds have been equal to the objectives, the distance-to-speed function left intact is used as the command deceleration pattern concerning the residual distances to the objective position.

In another preferred embodiment of the present invention, an elevator speed control system may comprise, in combination, an elevator car, a first speed pattern generator means for generating a command speed pattern, second speed pattern generator means for generating a second speed pattern delayed a predetermined time interval with respect to the command speed pattern during the acceleration, distance-of-movement calculating means for calculating theoretical distances of movement due to the command speed pattern, memory means for writing and reading the calculated theoretical distances of movement into and out from the same, position-to-speed converter means for generating a speed pattern dependent upon a position of the elevator car immediately prior to the stop thereof, distance corrector means for correcting the theoretical distances of movement by predetermined distances respectively, the memory means storing the second speed pattern concerning the theoretical distances of movement corrected by the distance corrector means in the form of a distance-to-speed function during the acceleration, means for utilizing said second speed pattern stored in the memory means to generate a command deceleration pattern during the deceleration, and means for smoothly changing the command speed pattern to the speed pattern provided by the position-to-speed converter means.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENT

Figure 1:
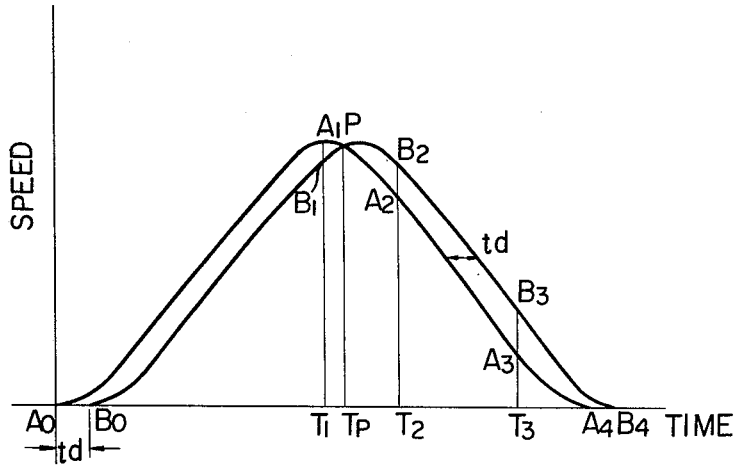
FIG. 1 is a graph illustrating a command speed pattern for an elevator car formed in accordance with the principles of the present invention, and an actual speed pattern for the elevator car.

The present invention provides an elevator car speed control system using for example, a command speed pattern including an acceleration section thereof identical in shape to a deceleration section thereof as shown in FIG. 1 wherein a command speed and the actual speed for an associated elevator car are plotted in ordinate against time in abscissa. According to the principles of the present invention, a command speed pattern $A_0A_1A_2A_3A_4$for the acceleration of an associated elevator car is generated until a command maximum speed is reached at a point $A_1$ or at a time point $T_1$ as shown in FIG. 1. Thereafter the car is commanded to decelerate following the deceleration section of the speed pattern identical in shape to the acceleration section thereof until it is stopped at a point $A_4$. However the car actually follows a speed pattern $B_0B_1B_2B_4$ having a time delay relative to the command speed pattern $A_0A_1A_2A_3A_4$ because an elevators speed control system involved includes a time delay element or elements. The speed pattern $B_0B_1B_2B_3B_4$ is called hereinafter the actual speed pattern.

It is now assumed that the actual speed pattern for an elevator car follows up a command speed pattern therefor with a predetermined time delay of td maintained therebetween and that, when the car travels a predetermined distance, a command speed pattern such as shown in FIG. 1 is generated until the car ideally reaches a command stop position or an objective position.

Under these circumstances, points $A_1$, $A_2$, $A_3$ and $A_4$ on the command speed in the deceleration region indicate respective magnitudes of the speed as determined with respect to residual distances to command stop positions for the car. For example, a magnitude of the speed $A_1T_1$ is determined with respect to a distance corresponding to an area defined by a curve section $B_1B_4$, an associated portion $T_1B_4$ of the time axis and sections of vertical line $T_1B_1$. Also with resepct to another distance corresponding to an area defined by a curve section $B_3B_4$, an associated portion of the time axis $T_3B_4$ and a section of a vertical line $B_3T_3$, a magnitude $A_3T_3$ of the speed is determined. In other words, the residual distance is obtained by integrating that section of the speed pattern extending from the associated point on the speed pattern to the end thereof with respect to time.

Assuming that a command speed pattern includes an acceleration section identical in shape to a deceleration section thereof only for purposes of simplification, the present invention provides an elevator speed control system including means for generating a first command speed pattern during acceleration, means for generating a second command speed pattern having a predetermined time delay relative to the first command speed pattern, memory means for storing the second command speed pattern converning residual distances dependent upon the command speed pattern, means for forming an ideal command speed pattern during the deceleration concerning residual distances to a command stop position of the stored speed pattern, and means for causing the command speed pattern during the decelerating to follow up that ideal command speed pattern.

Figure 2:
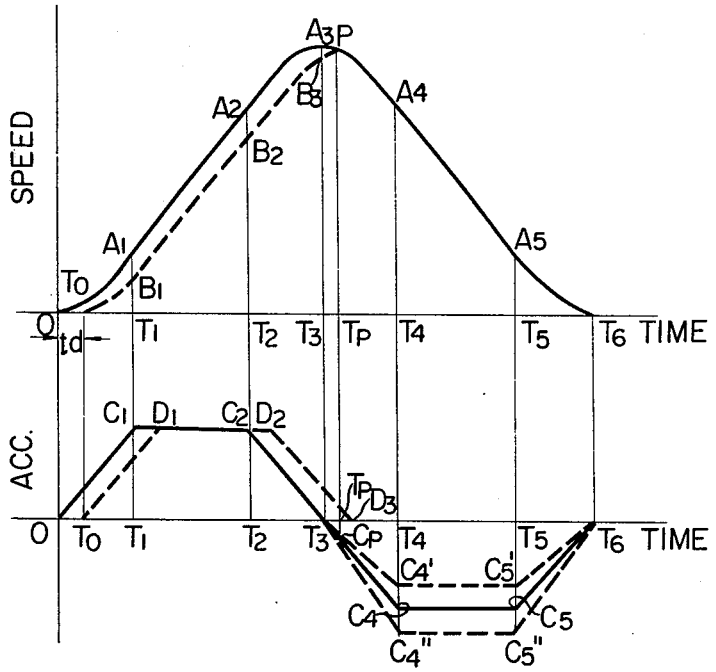
FIG. 2 is a graph illustrating the temporal relationship between a command speed pattern and an acceleration pattern formed in accordance with the principles of the present invention with an elevator car traveling at a speed less than its rated speed.

Referring now to FIG. 2, there are illustrated an acceleration pattern (see the lower portion thereof) and a corresponding command speed pattern (see the upper portion thereof) plotted on the same time axis with actual speed pattern (see the upper portion thereof). As above described, there is stored during the acceleration the temporal relationship concerning the predetermined time delay between the command speed pattern and the actual speed pattern during the deceleration. Therefore, in FIG. 2 speeds at various points on the command speed pattern $OA_1A_2A_3$ are sucessively stored with respect to ideal distances of movement of the particular elevator car due to the command speed pattern. For example, a magnitude of speed $B_1T_1$ at a point $A_1$ is stored with respect to a distance corresponding to an area defined by a closed curve $OA_1T_1O$ and a magnitude thereof $B_2T_2$ at a point $A_2$ is stored with respect to a distance corresponding to an area defined by a closed curve $OA_1A_2T_2O$. In this way, a second speed pattern shown at broken curve $T_0B_1B_2B_3$ in FIG. 2 is stored as a distance-to-speed function following the command speed pattern $OA_1A_2A_3$ until both speed patterns intersect each other at a point P. Thereafter the stored second speed pattern is extracted in accordance with residual distances to a desired stop position thereby to form an ideal command speed pattern during the deceleration. Then a command speed pattern is generated so as to follow up that ideal command speed pattern during the deceleration.

FIG. 2 also shows a corresponding acceleration patterns on the lower portion thereof. An acceleration pattern shown at solid line is linearly increased from its null value at a time point 0 to a predetermined value $C_1T_1$ at a time point $T_1$ along a segment of a straight line $OC_1$ and then maintained at the predetermined value to a time point $T_2$ as shown at a horizontal segment of a straight line $C_1C_2$ after which it is linearly decreased to its null value at a time point $T_3$ along a segment of a straight line $C_2T_3$ equal and opposite in slope to the segment $OC_1$. The acceleration pattern $OC_1C_2C_3$ formed of those broken lines is integrated to provide the command speed pattern in which, for example, command speeds $A_1T_1$, $A_2T_2$ and $A_3T_3$ appear at time points $T_1$, $T_2$ and $T_3$ respectively.

At and after the time point $T_3$ where the command speed reaches it maximum, an acceleration pattern for the deceleration of the car or a deceleration pattern is generated which is a mirror image of the acceleration pattern $OC_1D_1T_3$ with respect to the time axis and has a first segment of a straight line $T_3C_4$ forming an extension of the segment $C_2T_3$. The deceleration pattern is expressed by a set of broken lines $T_3C_4$, $C_4C_5$ and $C_5T_6$.

In FIG. 2 a set of broken lines $T_0D_1$, $D_1D_2$ and $D_2D_3$ designates an acceleration pattern corresponding to the second speed pattern $T_0B_1B_2B_3P$.

Figure 3:
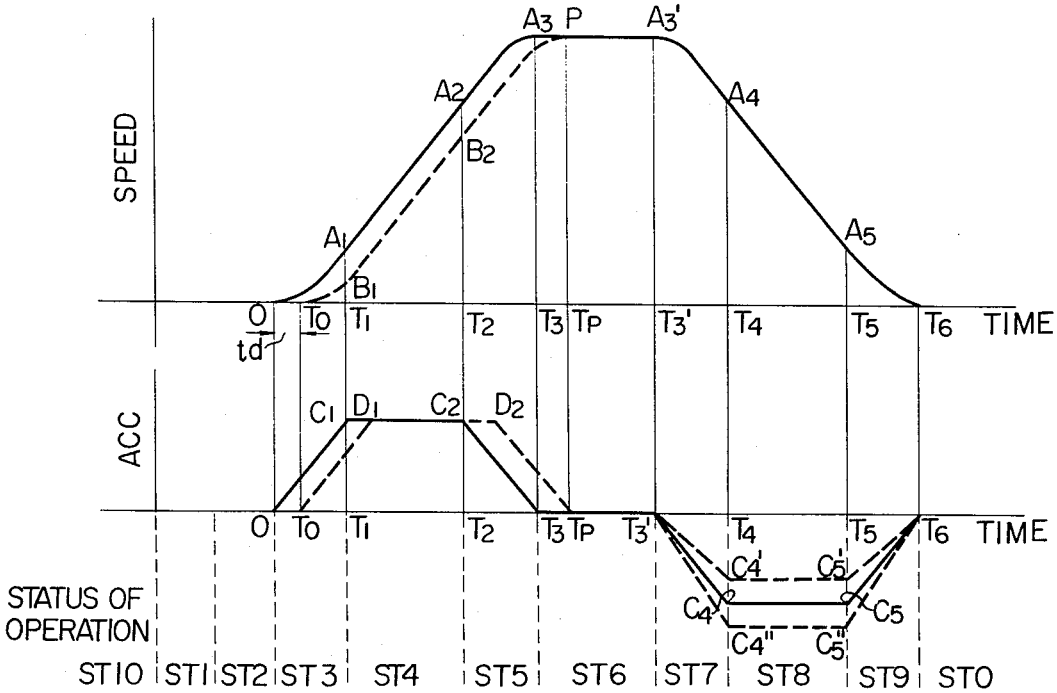
FIG. 3 is a graph similar to FIG. 2 but illustrating an elevator car reaching its rated speed.

While FIG. 2 illustrates the operation of an elevator car at a speed less than its rated speed FIG. 3 illustrates the operation of the car at a speed reaching the rated speed thereof. In FIG. 3 wherein like reference characters designate the components identical or corresponding to those shown in FIG. 2, the command speed pattern $OA_1A_2A_3A_4A_5A_6$ includes a region maintained at a constant speed or a rated speed between time points $T_3$ and $T_3'$ and the second speed pattern $T_0B_1B_2P$ reaches the rated speed at the time point $T_P$ and then is maintained at that rated speed. At the point P a magnitude of the speed $PT_P$ is stored as the last stored magnitude of the speed concerning a distance of movement of the particular elevator car due to the second speed pattern which distance corresponds to an area defined by a curve section $OA_1A_2A_3P$, a corresponding section of the time axis and a segment of vertical line $PT_P$ as above described. Thereafter the memory means halts to store the second speed pattern concerning the distances of movement of the car resulting from the command speed pattern.

Then a time point $T_3'$ is reached where the speed of the car is determined to be initiated to decelerate, but the ideal command speed is maintained at the speed $PT_P$ until a residual distance to a desired stop position becomes equal to the distance of movement for the last stored speed. When the residual distance is smaller than that distance of movement, a stored speed less than the last stored speed by one unit is read out. Then the smaller speeds are successively read out with a decrease in residual distance to form an ideal command speed pattern concerning the residual distances.

Figure 4:
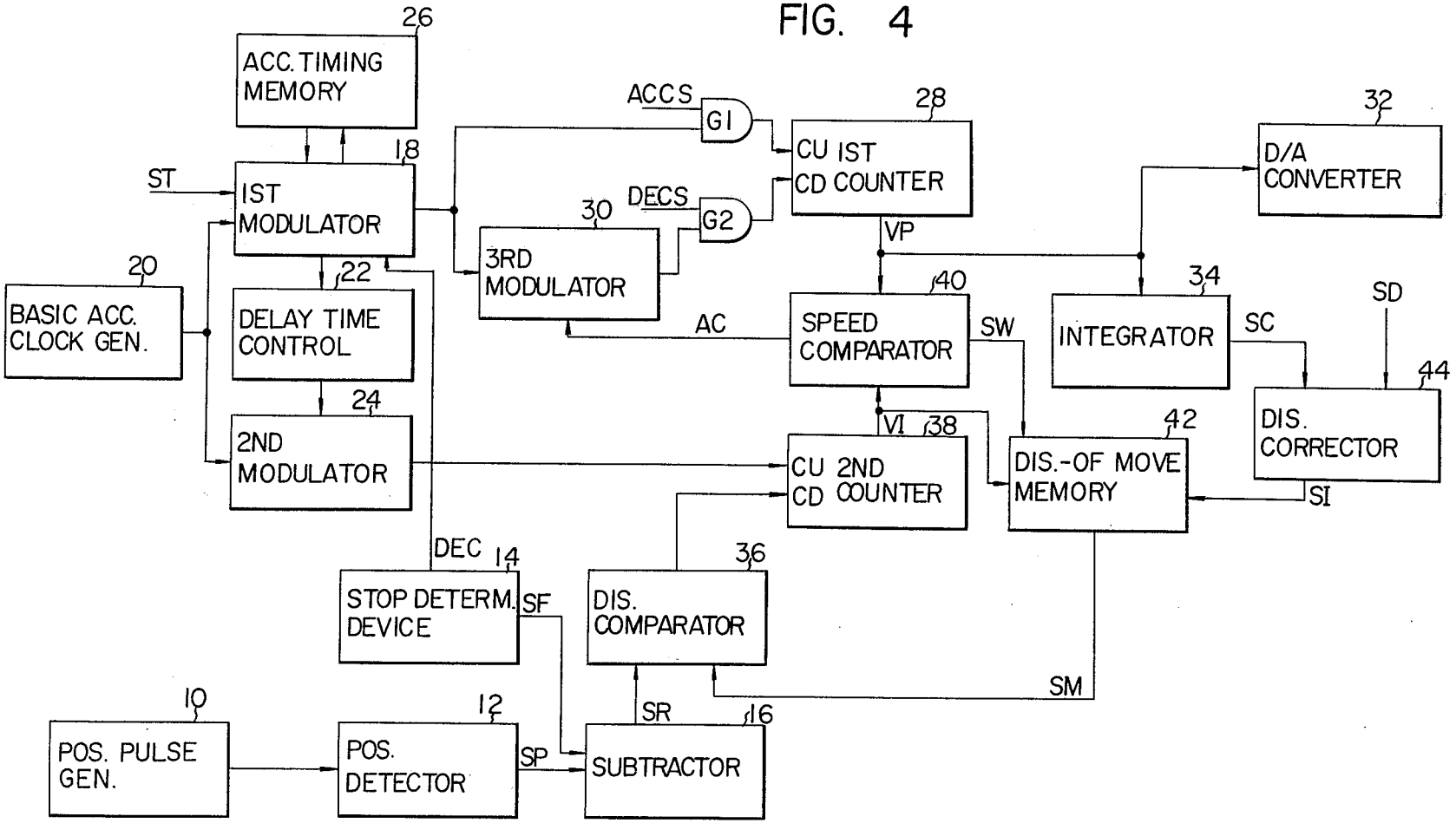
FIG. 4 is a simplified block diagram of an elevator speed control system constructed in accordance with the principles of the present invention.

Referring now to FIG. 4, there is illustrated an elevator car-speed control system constructed in accordance with the principles of the present invention as above described in conjunction with FIGS. 1, 2 and 3. The arrangement illustrated comprises a positional pulse generator 10 for generating positional pulses whose number is proportional to a distance of movement of an associated elevator car (not shown), and a car position detector 12 connected to the positional pulse generator 10 to detect the actual distances $S_{SP}$ from a reference position (which generally refers to the lowermost or uppermost floor of a building served by an associated elevator system).

The arrangement further comprises a stop determination device 14 for calculating both a time point (or the time point $T_2$ shown in FIG. 2) where an acceleration is initiated to decrease in order to stop the car at a called floor of the building and a position of a command floor SF. The stop determination device 14 delivers a stop floor signal SF and a stop determination signal DEC to a subtracter 16 and a first modulator 18 respectively. The stop floor signal SF indicates the absolute distance of the car from the reference position. The subtracter 16 compares the distance signal SP from the position detector 12 with stop floor signal SF from the stop determination device 14 to provide a difference signal therebetween or a signal SR for the residual distance to the stop floor.

A basic acceleration clock generator 20 generates a train of acceleration clock pulses as will be described hereinafter and is connected to the first modulator 18. In the first modulator 18 the acceleration clock pulses from the generator 20 are frequency modulated into a trapezoid as shown at $OC_1C_2T_3$ in FIG. 2. The frequency modulated clock pulses are supplied to a delay time control 22 connected to a second modulator 24. The second modulator 22 are also applied with the basic acceleration clock pulses from the clock generator 20 to frequency modulate them with a time delay relative to the frequency modulation of the first modulator 18 as determined by the delay time control 22. Thus the second modulator 24 delivers second acceleration pulses frequency modulated into a trapezoid as shown at $T_0D_1D_2T_3$ in FIG. 2 and delayed a predetermined delay time td (see FIG. 2) with respect to the acceleration pulses from the first modulator 20. The first modulator is shown in FIG. 4 as being connected to an acceleration timing memory 26 for storing a time interval between the start of the car and the initiation of a decrease in acceleration.

In addition, the frequency modulated clock pulses from the first modulator 20 is supplied to an UP input to a first reversible counter device 28 through gate means G1 applied with acceleration signal ACCS and also to a DOWN input to the first counter 28 through a third modulator 30 and another gate means G2 applied with deceleration signal DECS.

An output VP from the counter device 28 forms the command speed pattern $OA_1A_2A_3$ as shown in FIG. 2 and is applied to a digital-to-analog converter 32 which, in turn, delivers a command speed in the analog form to a mating driving system (not shown) for the associated elevator car. The output VP form the first counter device 28 is also applied to an integrator 34 to be integrated to form a distance-of-movement signal SC dependent upon the command speed pattern.

The residual distance signal SR from the subtracter 16 is applied to a distance comparator 36 connected to a DOWN input to a second reversible counter device 38 including an UP input having applied thereto the second acceleration pulses from the second modulator 24. An output or a second command signal VI from the second counter device 38 is supplied to a speed comparator 40 also applied with the command signal VP from the first counter device 28. The speed comparator 40 supplies an acceleration correction signal AC to the third modulator 30 and a switching signal SW to a distance-of-movement memory 42 for changing the latter from the writing to the reading mode of operation.

The integrator 34 integrates the command speed signal VP from the first counter device 28 to delivers a theoretical distance-of-movement signal SP to a distance corrector 44. The distance corrector corrects the distance signal SP in accordance with a distance correction signal SD applied thereto to produce a corrected theoretical distance-of-movement signal SI that is, in turn, applied to the distance-of-movement memory 42. On the other hand, the second speed signal VI is applied to the memory 42. Thus each time the second counter device 38 counts one pulse up during the acceleration, the distance-of-movement signal SI is stored in the memory 42 and indeed at an address as determined by the second command speed signal VI from the second counter device 38 after having been corrected by the distance corrector 44. During the deceleration, the distance-of-movement signals SM are successively read out from the memory 42 in the manner as will be described hereinafter. The memory 42 is formed of a random access memory enabled to perform both the writing-in and reading-out operations.

In order to avoid an abrupt change in acceleration of car, the speed comparator 40 may perform the function that it is not operated unless the command speed pattern exceed the second speed pattern by a predetermined amount that is to say, it senses the so-called dead zone concerning the speed.

The operation of the arrangement as shown in FIG. 4 will now be described with reference to FIG. 2 depicting an elevator car traveling at a speed not reaching its rated speed. At the start of an elevator car, the first modulator 18 responds to the starting signal ST to frequency modulate the basic acceleration pulses from the basic acceleration clock generator 20 into a trapezoid such as the acceleration waveform $OC_1C_2T_3$ shown in FIG. 2. Since the car is being accelerated, the acceleration signal ACC is applied to the gate means $G_1$ to permit the frequency modulated pulses to pass through the gate means $G_1$. Then the pulses are successively applied to the UP input to the first counter device 28 to be counted up resulting in a command speed curve or pattern $OA_1A_2A_3$, shown in FIG. 2. It will readily be understood that the acceleration clock pulses may be frequency modulated into any desired waveform such as a stepped waveform as long as the waveform is symmetric.

On the other hand, the second modulator 24 generates an acceleration pattern in the form of a trapezoid $T_0D_1D_2D_3$ shown at dotted line in FIG. 2.

As above described, the acceleration pattern $T_0D_1D_2D_3$ lags behind the command acceleration pattern $OC_1C_2T_3$ by a delay time td as predetermined by the delay time control 22. The second acceleration pulses from the second modulator 24 are applied to the UP input to the second counter device 38 to be counted up resulting in a second command speed pattern shown at dotted line $T_0B_1B_2B_3$ in FIG. 2.

The command speed signal VP from the first counter 28 is integrated into a theoretical or calculated distance of movement SC of the car by the integrator 34, assuming that the car would have traveled at the command speed. The theoretical distance of movement SC is supplied to the distance corrector 44 where it is added with a predetermined correction distance SD. Thus the distance corrector 44 delivers a corrected distance of movement SI to the distance-of-movement memory 42.

It is now assumed that the correction distance SD is null only for purposes of simplification.

On the other hand, the positional pulse generator 10 generates positional pulses as the car travels in one of the ascending and descending directions and the position detector 12 detects the actual position SP of the car. Also the stop determination device 14 determines a time point $T_2$ (see FIG. 2) at which the acceleration is decreased so as to stop the car at a called floor or a desired stop floor to deliver the stop determination signal DEC to the first modulator 18 while delivering a position of the called floor to the subtracter 16. A residual distance SR to the desired floor calculated by the subtracter 16 is supplied through the distance comparator 36 to the DOWN input to the second counter device 38. As above described, the second counter device 38 applies the second command speed VI to the distance-of-movement memory 42 where the distance of movement SI from the distance corrector 44, in this case, equal to the SC is stored or written at an address specified by the second command speed VI from the second counter device 38 and in synchronization with the counting operation performed by the second counter device 38. For example, the memory 42 stores a distance corresponding to an area defined by a closed line $OA_1T_1O$ at a time point $T_1$ at an address as determined by a second command speed $B_1T_1$ and another distance corresponding to an area defined by a closed line $OA_1A_2T_2O$ at a time point $T_2$ at an address as determined by a second command speed $B_2T_2$ (see FIG. 2).

In this way the intact theoretical distances of movement of the car are stored in the memory 42 one after another and concerning the associated command speeds VP along the second command speed pattern $T_0B_1B_2B_3$ shown in FIG. 2. That is, the distances of movement SI of the car are successively stored in the memory 42.

Then a time point $T_3$ is reached at which the command speed is maximum after which the car enters the deceleration region. During the deceleration, the first modulator 18 frequency modulates the acceleration pulses from the basic acceleration clock generator 20 into a trapezoid to deliver a command acceleration pulses as during the acceleration. In this case, however, the acceleration signal ACCS disappears to close the gate means G1 while a deceleration signal DEC is applied to the gate means G2. Thus the command acceleration pulses from the first modulator 18 pass through the gate means G2 and the third modulator 30 and thence to the DOWN input to the first counter device 28 to be counted down. Namely, the first counter device 28 gives the result similar to that forming a negative acceleration pattern $T_3C_4C_5T_6$ (see FIG. 2) and delivers a command speed pattern $A_3A_4A_5T_6$ (see FIG. 2) during the deceleration. As shown in FIG. 2, a negative magnitude of the acceleration pattern should be decreased at a time point $T_5$ during the deceleration. To this end, the acceleration timing memory 26 is designed and constructed so that it preliminarity stores a command speed VC at a point $C_2$ on the acceleration pattern at a time point $T_2$ during the acceleration and delivers a signal for the time point $T_3$ as determined by the relationship VP = VC.

On the other hand, the memory 42 continues to store the distances of movement SI concerning the command speed VP until the switching signal SW is applied to the memory 42 at a point where the command signal VP equals the second command speed VI. This results in the memory changing from the writing to the reading mode of operation. This the memory 42 halts to the storing operation and the distance of movement $SM_n$ at the point P where the command speed has reached its maximum is conversely read out from the memory 42 by using its address represented by a corresponding value $PT_p$ of the second command speed VI from the second counter device 38. The distance of movement thus read out corresponds to an area defined by a closed line $OA_1A_2A_3PT_pO$ (See FIG. 2) and is held. With the lapse of time the command speed VP is decreased following the command speed pattern $PA_4A_5T_6$ (see FIG. 2). The distance comparator 36 compares the residual distance SR with the last stored distance of movement $SM_n$. At a time point where the signal SR is smaller than the signal $SM_n$ the distance comparator 36 applies a speed change signal to a DOWN input to the second counter device 38 whereby the latter counts one pulse down. As a result, the second counter device 38 causes the memory 42 to provide a distance of movement signal $SM_{n-1}$ concerning that command speed less one unit than the just preceding command speed.

In this way the distances of movement SM successively read out from the memory 42 are successively compared with the corresponding residual distances SR from the subtracter 16 while the second counter device 38 successively counts down so far as the signal SM is greater than the signal SR. The distances of movement SI concern the command speeds VP stored in the memory 42 during the acceleration and in accordance with the residual distances SR to the desired floor and the second command speed VI from the second counter device 38 results in an ideal command speeds preliminarily set with respect to the residual distances.

While the memory 42 has stored the distances of movement SI concerning the command speeds VP the same has actually stored the second command speeds VI concerning the distances of movement SI.

As above described, the speed comparator 40 compares the command speed VP from the first counter device 28 with the second command speed VI. When VP > VI as determined thereby, the speed comparator 40 applies to the third modulator 30 such as an acceleration correcting signal AC that the absolute value of the acceleration increases within a predetermined range defined by two sets of dotted broken lines $C_pC_4'$, $C_4'C_5'$, $C_5'T_6$ and $C_pC_4''$, $C_4''C_5''$, $C_5''T_6$ shown in FIG. 2 thereby to decrease the command speed. On the contrary, when VP < VI, the absolute value of the acceleration is decreased within that predetermined range. Also, with the command speed VI equal to the second command speed VI, the acceleration is maintained at values of the acceleration pattern $C_pC_4C_5T_6$ originally formed.

The third modulator 30 is responsive to the acceleration correcting signal AC to frequency modulate the command acceleration pulses from the first modulator 18 to such an extent that a ride in the car is not deteriorated. The frequency modulated pulses from the third modulator 30 are supplied to the DOWN input to the first counter device 28 through the gate means G2.

From the foregoing it will be appreciated that the command speed VP follows up the second command speed VI and that a command speed pattern can be provided approximating an ideal command speed pattern fulfilling the relationship between the residual distance and command speed required for the car to be permitted to ideally arrive at a desired floor, on the assumption that the actual speed of the car follows up the command speed with a predetermined time delay.

When the speed of the elevator car reaches its rated speed, the arrangement of FIG. 4 performs the identical operation as above described in conjunction with FIG. 2 and 4 except for the operation of the memory 42. In the latter case, the memory 42 continues to successively write the distances of movement SI therein until a point P (see FIG. 3) is reached. As shown in FIG. 3, the second command speed VI becomes maximum at that point P. Then the memory 42 conversely read and hold the last stored distance of movement $SM_n$ as previously described until the residual distance SR to the desired floor becomes smaller than that distance $SM_n$.

The distance corrector 44 will now be described. When the car is intended to land at a desired position, one generally uses a position-to-speed converter (not shown) to generate a landing pattern suitable for that position immediately before the car lands thereat in order that the car accurately land at the desired position. With such a position-to-speed converter used, the distance corrector 44 is operative to merge the command speed pattern into the landing pattern by adding a suitable correction distance SD to the theoretical distance of movement SC. It is assumed that the command speed pattern is transferred to the landing pattern from the position-to-speed converter at a predetermined distance SL short of the desired stop position. Under the assumed condition a predetermined value VL of the command speed is present at the transferring point. Thus it is required to equal to equal the theoretical distance of movement SC due to the command speed VP to the predetermined distance SL upon the second command speed VI equaling the command speed VP. Therefore the distance correcter 44 is sufficient to store therein the correcting distance SD meeting the relationship $$SI + SD = SL$$

for VI = VL during the acceleration and to deliver to the memory 42 the sum of the theoretical distance SC and the correcting distance SD.

Figure 5:
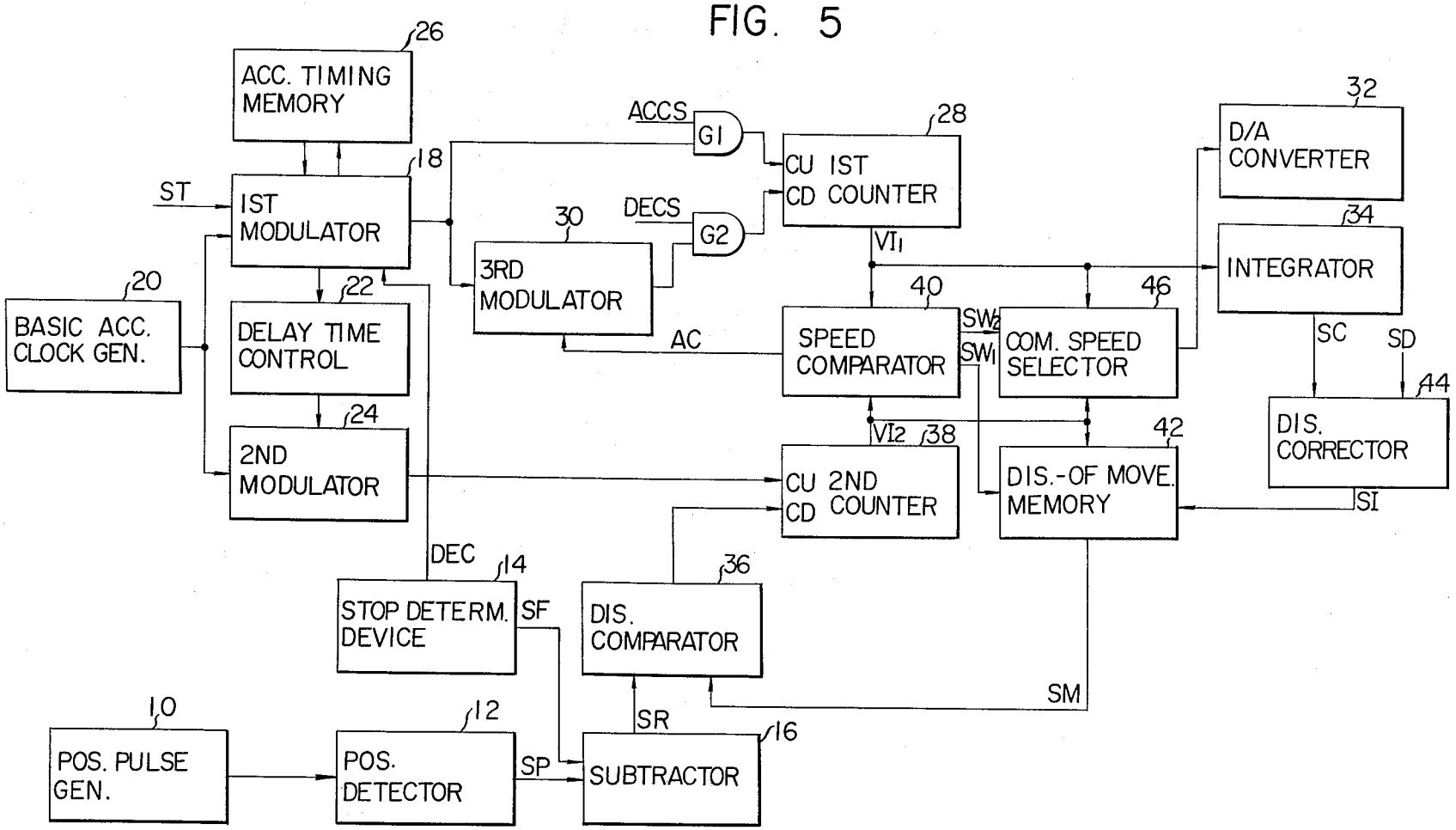
FIG. 5 is a simplified block diagram of a modification of the present invention.

FIG. 5 wherein like reference numerals designate the components identical those shown in FIG. 4 illustrates a modification of the arrangement as shown in FIG. 4. The arrangement illustrated is different from that shown in FIG. 4 only in that a command speed selector 46 is connected between the first counter device 28 and the digital-to-analog converter 32 and also to the output of the speed comparator 40.

The operation of the arrangement shown in FIG. 5 will now be described with reference to FIG. 6 where there are illustrated a command speed pattern and a second command speed pattern similar to those shown in FIG. 2 and like reference characters have the same meaning as those shown in FIG. 2. As in the arrangement of FIG. 4, a first command speed $VI_1$ from the first counter device 28 follows a solid curve $OA_1A_2A_3P$ while a second command speed $VI_2$ from the second counter device 38 follows a dotted curve $T_0B_1B_2B_3P$. It is noted that the first and second command speeds $VI_1$ and $VI_2$ are identical to the command speed VP and the second command speed VI shown in FIG. 4 respectively. At a time point $T_p$ where the first command speed $VI_1$ is equal to the second command speed $VI_2$, the speed comparator 40 delivers a switching signal $SW_1$ to the memory 42 to change the latter from the writing mode to the reading mode of the operation.

At and after the time point $T_p$ the second command speed $VI_2$ forms an ideal command speed concerning the residual distances SR to the desired stop position and stored in the memory 42 during the acceleration and the third modulator 30 is operated to modify the first command speed $VI_1$ to approach the that second command speed $VI_2$. Therefore the first command speed $VI_1$ becomes again equal to the second command speed $VI_2$ at a point P' or at a time point $T_p'$. The speed comparator 40 senses that the first and second command speeds are equal to each other and applies another switching signal $SW_2$ to the command speed selector 46. The speed selector 46 selects that second speed $VI_2$ to deliver it as a command speed VP. Thereafter those speeds concerning the distances of movement stored in the memory 42 during the acceleration form speeds concerning the residual distances to the desired stop position and the second command speeds $VI_2$ left intact serve as the command speeds VP.

Thus it is seen that, when the first command speed $VI_1$ is first equal to the second command speed $VI_2$ after the start of an associated elevator car, a first switching signal $SW_1$ is issued to the memory 42 to change it from the writing to the reading mode of operation, and the command speed selector 46 selects and delivers the first command speed $VI_1$ as the command speed VP until the first and second command signals are again equal to each other. Thereafter the command speed selector 46 selects and deliver the second command speed $VI_2$ as the command speed VP.

In other words, the acceleration is modified during the deceleration thereby to cause the car to follow an ideal command deceleration pattern preliminarily set, after which the command speed is formed of the speed pattern stored as a distance-to-speed function in the memory during the acceleration and left intact.

Figure 6:
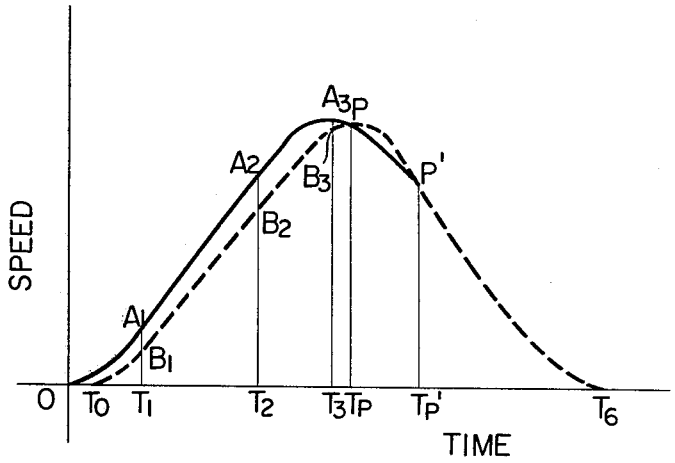
FIG. 6 is a graph illustrating a command speed pattern and a second speed pattern modified in accordance with the arrangement shown in FIG. 5.

When the elevator car travels at a speed reaching its rated speed, the memory 42 has held therein the last stored distance of movement (which corresponds to an area defined by a close line $OA_1A_2A_3PT_pO$ shown in FIG. 6) connering a maximum magnitude of the second command speed $VI_2$ till a point $A_3'$ (see FIG. 3) where the car is initiated to decelerate after the travel at the rated speed. In other respects the operation is identical to the operation as above described in conjunction with FIG. 6.

Figure 7:
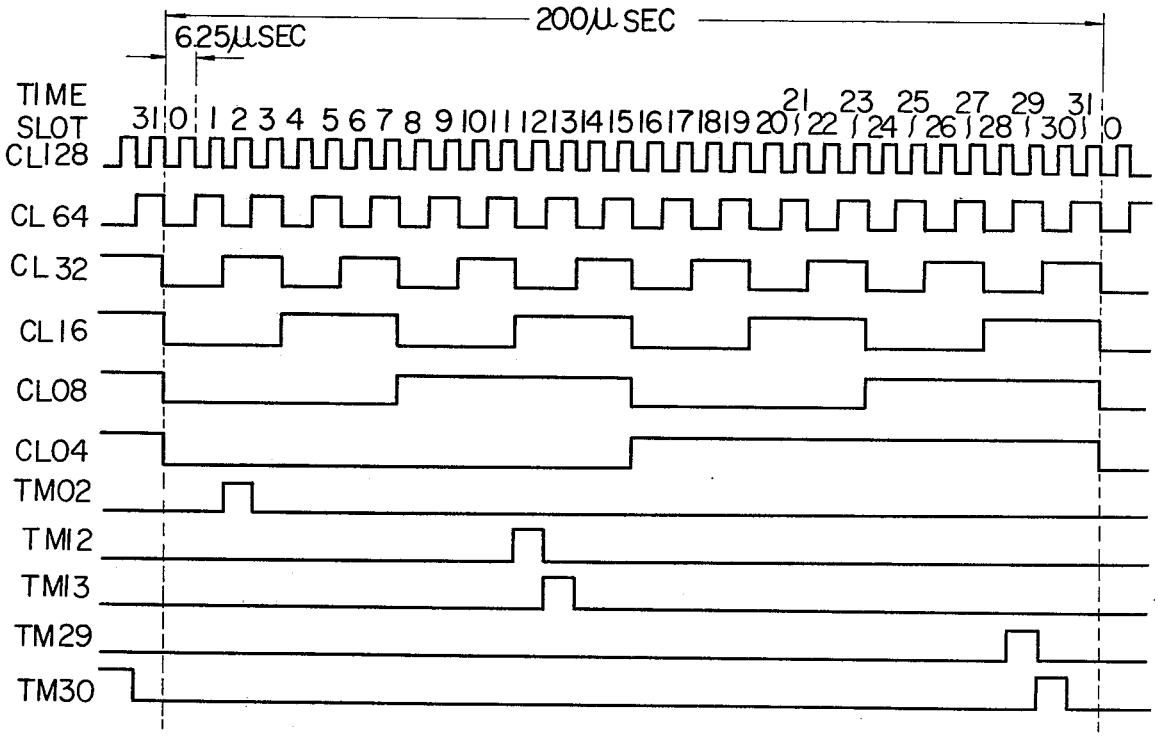
FIG. 7 is a time chart of the basic operation clock pulses, auxiliary clock pulses and timing pulses used with a preferred embodiment of the present invention.

Referring now to FIG. 7, there are illustrated a train of basic operation clock pulses used with a preferred embodiment of the present invention as will be described in detail hereinafter and various clock pulses and timing signals developed therein for one complete period of the fundamental operation thereof. As shown in FIG. 7, the fundamental operating period includes (32) basic operation clock pulses designated by CL128 having a pulse repetition frequency of 160 kilohertzs. Thus the fundamental operating period is of 200 microseconds. Also trains of clock pulses CL64, CL32, CL16, CL08 and CL04 shown in FIG. 7 are formed by frequency dividing the basic operation clock pulses CL128 by 2, 4, 8, 16 and 32 respectively. For example, the clock pulses CL04 have a pulse repetition period equal to the fundamental operating period.

FIG. 7 further shows timing signals TM02, TM012, TM13, TM29 and TM30 at specified temporal positions within the fundamental operating period respectively. In order to identify the temporal positions of the timing signals, the successive pulse periods of 6.25 microseconds of the basic operation clock pulses CL128 within the fundamental operating period are also called "time slots" 0, 1, 2, . . . 31 and the temporal position of each timing signal is indicated by a number of that time slot in which each timing signal has a value of binary ONE. For example, the timing signal TM13 has its temporal position identified by the time slot 13. Those timing signals are formed of the clock pulses CL 64 through CL04 followings the Boolean expressions.

$$TM02 = \overline{CL64}\cdot CL32\cdot\overline{CL16}\cdot\overline{CL08}\cdot\overline{CL04}$$

$$TM12 = \overline{CL64}\cdot\overline{CL32}\cdot CL16\cdot CL08\cdot\overline{CL04}$$

$$TM13 = CL64\cdot\overline{CL32}\cdot CL16\cdot CL08\cdot\overline{CL04}$$

$$TM29 = CL64\cdot\overline{CL32}\cdot CL16\cdot CL08\cdot CL04$$

and $$TM30 = \overline{CL64}\cdot CL32\cdot CL16\cdot CL08\cdot CL04$$

One embodiment of the present invention will now be described in conjunction with FIG. 8 et seqq wherein there are illustrated circuit configurations of the blocks shown in FIGS. 4, 5 and 6.

Figure 8:
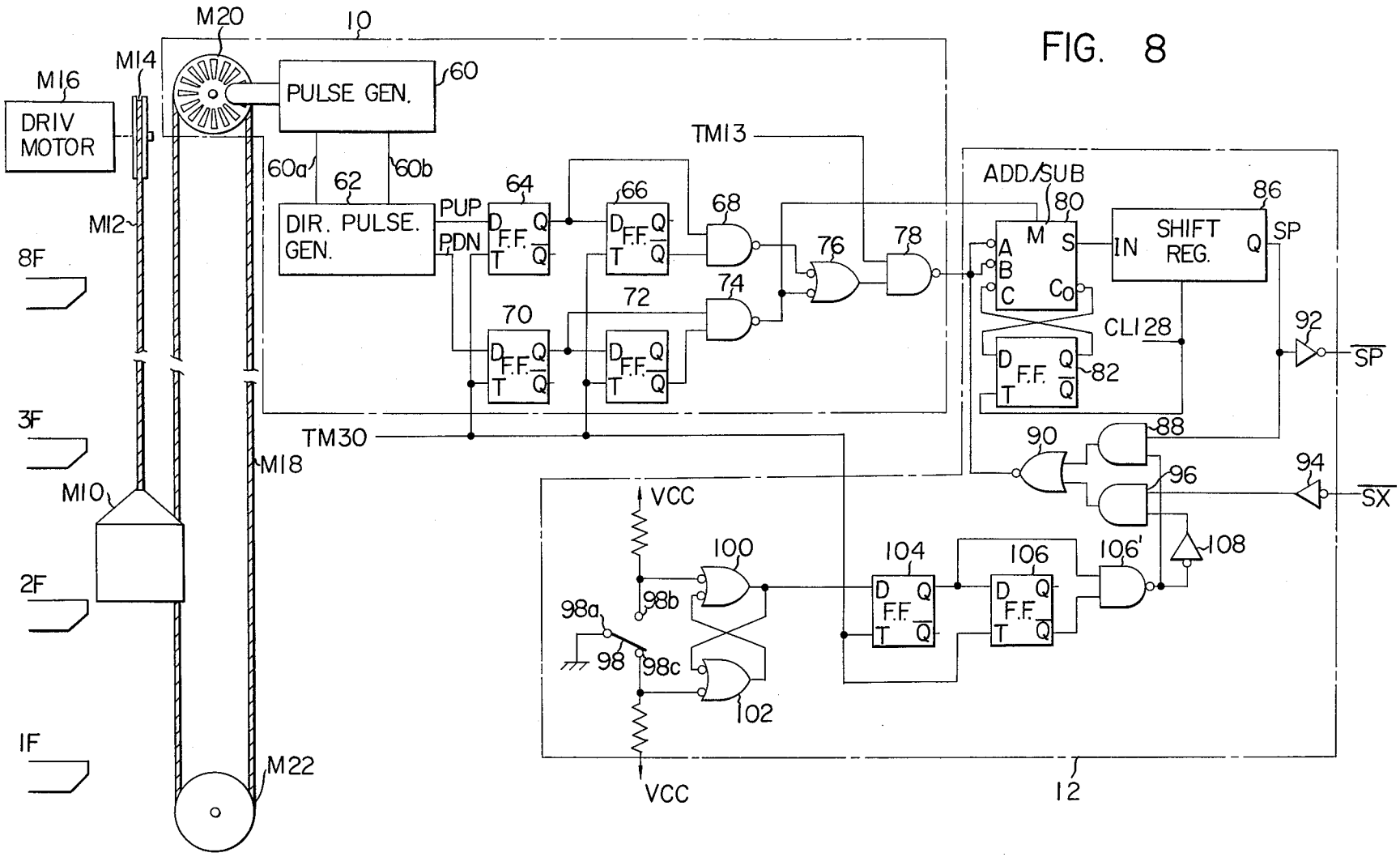
FIG. 8 is a circuit diagram of a model made for an elevator position detection mechanism constructed in accordance with the present invention and a schematic view of an elevator system operatively associated with the position detection mechanism.

It is to be noted that in FIG. 8 et seqq and in the description therefore the reference characters designating each signal represents that signal having one significant logic level having a value of binary ONE without the upper bar thereof and having the other significant logic level having a value of binary ZERO with the upper bar. For example, the signal SP has a value of binary ONE and the signal $\overline{SP}$ has a value of binary ZERO. However, in FIGS. 4, 5 and 6 every signal has been designated by corresponding reference characters without the upper bar thereof and its binary value has been discarded.

FIG. 8 shows a simplified model for a mechanism for sensing a position of an associated elevator car and a circuit configuration thereof. The arrangement illustrated comprises a modeled elevator system including an elevator car M10 supported by a winding rope M12 operatively connected to a traction sheave M14 disposed above an upper end of the travel of the car M10 in an associated hatchway (not shown) and an electric reversible motor M16 operatively connected to the traction sheave M14 to drive the latter thereby to wind and unwind the winding rope M12 on and from the sheave M14. The motor M16 may be a DC motor such as used in the Ward-Leonard drive system. The elevator car M10 is also connected at the upper and lower ends to a governor rope M18 in the form of a loop spanned between a governor sheave M20 and a pulley M22 located above the upper end and bottom of the hatchway respectively. The governor rope M18 is moved always at the same speed as the car M10 and also connected to an emergency stop device (not shown) disposed within the car M10. If the emergency stop device is actuated then the governor rope M18 transmits the operation thereof to the car M10 to stop the latter.

The elevator system illustrated is adapted to serve eight floors 1F, 2F, 3F, . . . 8F of a building (not shown).

The governor sheave M20 is shown in FIG. 8 as forming a positional pulse generator 10 with a pulse generator 60 operatively connected thereto. The pulse generator 60 responds to the rotational movement of the governor sheave M20 to generate two sets of pulses **60*a* and 60*b*** in the quadrature phase relationship.

The two sets of the pulses **60*a* and 60*b* are applied to a directional pulse generator 54. The directional pulse generator 62 is operative to discriminate a direction of travel of the car M10 so that during the upward travel of the car M10, an UP pulses PUP is generated in synchronization with each of the pulses 60*a* or 60*b* from the positional pulse generator 10 while during the downward travel of the car a DOWN pulse PDN is generated in synchronization with each of the pulses 60*b* or 60*a*. Each UP pulse PUP is applied to a series combination of two D FLIP-FLOP's 64, abd 66 and a NAND gate 68 interconnected in tandem manner. More specifically, the FLIP-FLOP 64 has its input D connected to the UP pulses PUP and its output Q connected to the FLIP-FLOP 66 at the input D. Then the FLIP-FLOP 66 is connected at the output $\overline{Q}$ to one input to the NAND gate 68 including the other input connected to the output Q of the FLIP-FLOP 64. Both FLIP-FLOP's have clock inputs T applied with the timing signal TM30. The series combination 64–66–68** is operative to convert each UP pulse PUP to a pulse having a pulsewidth equal to the pulse repetition period of the timing signal TM30.

Similarly each DOWN pulse PDN is applied to a series combination of D FLIP-FLOP's 70 and 72 and a NAND gate 74 identical in construction and connection to the series combination 64–66–68 to be converted to a pulse having a pulsewidth equal to the pulse repetition period of the timing signal TM30.

The pulse from the NAND gate 68 passes through an OR gate 76 to a NAND gate 78 to open the latter to permit the timing signal TM13 to pass through the now opened NAND gate 78. This true in the case of the pulse from the NAND gate 74.

Thus it is seen that each of the UP and DOWN pulses PUP and PDN respectively is converted to a single pulse synchronized with the timing pulse TM13.

This pulse is then supplied to the actual position detector 12. As shown in FIG. 8, the actual position detector 12 includes a binary full adder/substracter 80 having an addition input A, an addition/substraction input B, a carry input C, an addition/substraction selection input M, a carry output $C_o$ and an operation output $S_o$ with the carry output and input $C_o$ and C respectively connected to an input D and an output Q of a D FLIP-FLOP 82. The full adder/subtracter 80 is adapted to perform the substraction with the addition/substraction selection input M having a value of binary ZERO while it performs the addition with the input M having a value of binary ONE. To this end, the output of the NAND gate 74 is also connected to the addition/substraction selection input M. Also the basic acceleration clock pulses CL128 from an inverter 84 are successively supplied to a clock input T of the FLIP-FLOP 82 thereby to return an carry output $C_o$ from the adder/substracter 80 back to the carry input C through the FLIP-FLOP 82 with a time delay corresponding to the pulse repetition period of the basic operation clock pulses CL128.

The operation output $S_o$ of the adder/substracter 80 is connected to an input IN to a shift register 86. In the example illustrated the shift register 86 serially includes thirty-two bit positions and may be form of four 8-bit shift registers as marketed under TTL-IC SN491A from Texas Instruments Incorp. serially interconnected. The shift register 86 has an output Q connected to the addition input A of the adder/subtracter 80 through an AND gate 88 and a NOR gate 90.

Thus it will be appreciated that the components 80, 82 and 86 form a 32-bit series adder/subtracter device.

Assuming that the elevator car is initiated to travel upwardly, the UP pulses PUP are successively generated from the directional pulse generator 62 and applied to the series combination 64–66–68. As above described, the pulses synchronized with the timing pulses TM13 one for each UP pulse are successively supplied to the adder/subtracter 80 at the addition/subtraction input B. At that time, the adder/subtracter 80 performs the additional operation because the addition/subtraction selection input M has a value of binary ONE supplied by the NAND gate 74. Accordingly the shift register 86 stores positional pulses in the form of a binary number, each of binary ONE's representing one unit distance of travel of the car corresponding to each UP pulse PUP, starting with a time slot 13 of the fundamental operating period (see FIG. 7) and in a direction to increase the time slot-number.

Assuming now that the content of the shift register 86 is reset when the car lands at a reference floor, for example, the lowermost floor, the shift register 86 provides at the output Q a binary 32-bit actual position signal SP representing a distance between the car and the reference floor, the signal SP being expressed in the form of 32 series bits with the least significant bit put in the time slot 13. The signal SP is applied to an inverter 92.

When the car is initiated to travel downwardly, the DOWN pulses PDN are successively generated from the directional pulse generator 62 and applied to the series combination 70–72–74. Then the pulses synchronized with the timing pulses TM13 are successively applied to the addition/subtraction input B of the adder/subtracter 80 as above described. At that time the adder/subtracter 80 has the addition/subtraction selection input M at its level of binary ZERO due to the output from the NAND gate 74 and therefore perform the subtraction. That is, each time a single DOWN pulse PDN Is developed, the positional pulses stored in the shift register 86 is substracted by one pulse. That is, the actual position registerred in the shift register 86 is successively decreased. This shift register 86 is called hereinafter an actual position register.

As shown in FIG. 8, an inverter 94 is connected to one input to an AND gate 96 subsequently connected to the other input to the NOR gate 90 while a predetermined floor position signal $\overline{SX}$ is applied to the inverter 94. A floor position signal $\overline{SX}$ represents a distance between an associated floor and the reference floor in terms of the number of the unit positional pulses and in the form of a 32-bit binary number with the least significant position thereof put in the time slot 13. The floor positional signal $\overline{SX}$ is formed by a circuit for setting up a position of a corresponding floor although such a circuit is not illustrated. The purpose of this circuit is to set up a position of a predetermined floor in order to register that position in the register by moving an associated elevator car to the predetermined floor upon installing the car or when the content of the register has much deviated for any reason.

In order to set an initial position of the car, a corresponding floor position signal $\overline{SX}$ is set in the shift resister 86 having the actual position of the car registerred therein. To this end, a transfer switch 98 is provided including a movable arm **98*a* connected to ground and a pair of stationary contacts 98*b* and 98*c* connected across an electric source VCC through respective resistors. The movable arm 98*a* normally engages the contact 98*c*. Both contacts 98*b* and 98*c* are connected to one input to a pair of NAND gates 100 and 102 forming a FLIP-FLOP with the other input to each gate connected to output of the other gate. The output of the NAND gate 100 is connected to the other input to the AND gate 88 through a series combination of D FLIP-FLOP's 104 and 106 and a NAND gate 106 identical in both construction and connection to the series combination of the D FLIP-FLOP's 64 and 66 and the NAND gate 68 as above described with the timing signal TM30 applied to clock inputs T to both FLIP-FLOP's. The gate 106 has its output also connected to the other input to the AND gate 96 through an inverter 108**.

With the movable arm **98*a* engaging the contact 98*c* of the switch 98 as shown in FIG. 8, the gate 100 provides an output of binary ZERO. However, the engagement of the movable arm 98*a* with the contact 98*b* causes the gate 100 to provide an output of binary ONE. Then the FLIP-FLOP's 104 and 106 and the NAND gate 106 are operated to cause the NAND gate 106** to produce a pulse having a pulsewidth corresponding to the pulse repetition period of the timing signal TM30 at the rise of the output from the NAND gate 100. This pulse is applied to the AND gate 88 to close it for one complete, fundamental operating period while at the same time being appoied to the AND gate 96 through the inverter 108 to open the gate 96 for same period. Thus the floor position signal SX is permitted to pass through the gate 96 to be applied to the addition input A to the adder/subtracter 80. As a result, the actual position signal SP stored to that time in the shift register 86 is entirely replaced by the new floor position signal SX.

Figure 9:
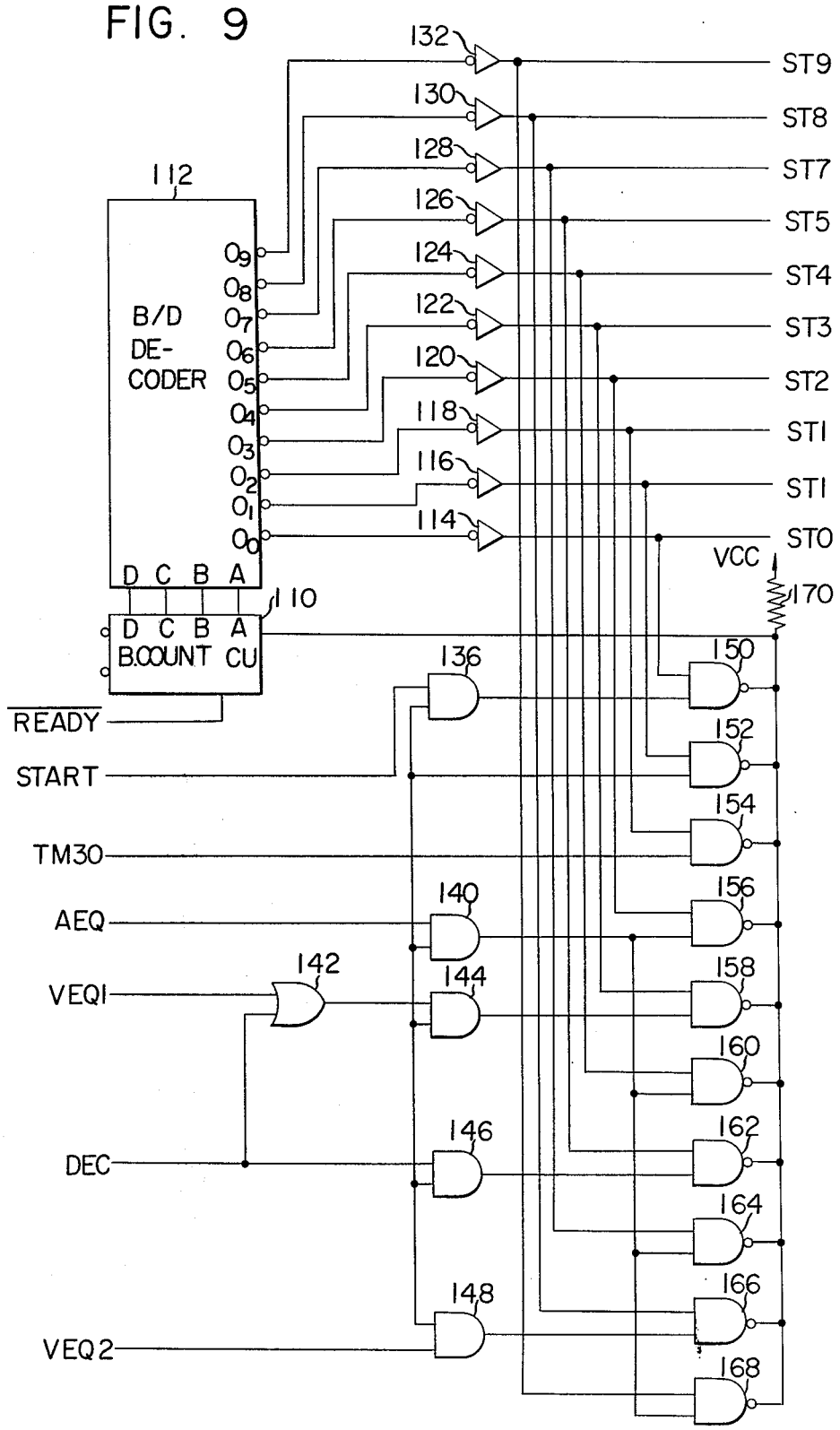
FIG. 9 is a circuit diagram of a status-of-operation signal generator used with the present invention.

In the embodiment illustrated the process of generating the command speed pattern is divided into ten statuses of operation 0 through 9 and status-of-operation signals designated by ST0, ST1, ST2, . . . ST8 and ST9 indicating such statuses of operation respectively are generated by a status-of-operation signal generator circuit as shown in FIG. 9.

The arrangement illustrated in Figure comprises a 4-bit binary counter 110 of the synchronous type such as commerically available under TTL-10 SN74193 from Texas Instruments Incorp. and a binary-to-decimal decoder 112 connected in bit parallel relationship to the binary counter 110. The decoder 112 may be one manufactured under TTL-IC SN7442A by Texas Instruments Incorp. A binary coded signal from the counter 110 is decoded by the binary-to-decimal decoder 112 to appear as a binary ZERO at a corresponding one of outputs $O_o$ through $O_9$ of the decoder 112. For example, with the elevator car maintained stopped, a ready-for-operation signal $\overline{\text{READY}}$ has a value of binary ONE and the counter 110 is in its reset state so that the decoder 112 provides an output of binary ZERO at the output $O_o$. This output of binary ZERO is applied to an inverter 114 which, in turn, provides a status-of-operation signal STO having a value of binary ONE representing the status of operation O. As shown in FIG. 9, the remaining outputs $O_1$ through $O_9$ of the decoder 112 are connected individual inverters 116 through 132 respectively.

If the car is to start, the ready-for-operation signal $\overline{\text{READY}}$ is put at its level of binary ZERO to develope a start signal START at a level of binary ONE. The start signal START is applied to an AND gate 136 to open it. A timing signal TM30 passes through the now opened gate 136 and thence through a NAND gate 150 also applied with the status-of-operation signal STO after which the timing signal enters a count input CU to the counter 110. Thus the counter 110 counts one pulse up to cause the inverter 116 connected to the output $O_1$ of the decoder 112 to provide an output or a status operation signal ST1 having a value of binary ONE, at the output of the inverter 116.

In the status of operation 1 the timing signal TM30 passes through a NAND gate 152 applied with the status-of-operation signal ST1 and in the status of the operation 2 the timing signal TM30 passes through a NAND gate 154 having the signal ST2 applied thereto. Thus it enters the count input CU of the counter 110. Each of the statuses of the operations 1 and 2, therefore, shifts to the next succeeding status of operation after a time interval in this case, 200 microseconds equal to the pulse repetition period of the timing signal TM30.

A status of operation 3 is shifted to a status of operation 4 by opening an AND gate 140 with an equality signal AEQ indicating that the absolute magnitude of command acceleration has become equal to a predetermined magnitude as will be described later and passing a time signal TM30 through the opened gate 140 and then through a NAND gate 156 applied with the status-of-operation signal ST3, after which it enters the counter 110. This results in the status-of-operation signal ST4 appearing at the output of the inverter 118 to indicate that the state of operation is shifted to the status 4.

In order to shift the status of operation 4 to the next succeeding status 5, with no rated speed reached as shown in FIG. 2, the stop determination device 14 (see FIG. 4) first computes a point where the command acceleration is to decrease in order to cause the car to land at a desired floor and then issues a stop determination signal DEC. This signal DEC is passed through an OR gate 142 to open and AND gate 144. This opening of the AND gate 144 permits the timing signal TM30 to pass through a NAND gate 148 applied with the status signal ST4 to enter the counter 110. This results in the shift of the status of operation 4 to the status of operation 5 indicated by the status signal ST5 appearing at the output of the inverter 124. Only for purposes of illustration, a circuit configuration of the stop determination device 14 is not illustrated.

On the other hand, with the rated speed reached as shown in FIG. 3, the actual car speed should be prevented from exceeding the rated speed. Therefore by issuing a signal VEQ1 (which will be described hereinafter) indicating that a command speed is equal in magnitude to a speed at a point where the command acceleration is to decrease or at the time point $T_2$ shown in FIG. 3, the shift of the status of operation is accomplished. That is, this signal VEQ1 is applied to the OR gate 142 to shift the status of operation 4 to the status 5 in the same manner as above described in conjunction with the stop determination signal DEC.

The shift of the status of operation 5 to a status of operation 6, of a status 7 to a status 8 and a status 9 to the status O is accomplished by issuing respective equality signals AEQ indicating that the corresponding command accelerations become equal to predetermined magnitudes respectively. Then the process as above described in conjunction with the firstmentioned equality signal AEQ is repeated to effect the desired shift of the status of operation.

To shift the status of operation 6 to the status 7, the stop determination signal DEC as above described is operated to open an AND gate 148 to permit the timing signal TM30 to be applied to the counter 110 through a NAND gate 162 in the similar manner as above described.

The shift of the status of operation 8 to the status 9 is accomplished by issuing a signal VEQ2 (which will be described later) indicating that the command speed is equal in magnitude to a speed at a point where the command acceleration is to decrease to cause the car to land at a desired floor. This signal VEQ2 opens an AND gate 148 to permit the timing signal TM30 to be applied to the counter 110 through an AND gate 166 having the status signal ST8 applied thereto. Therefore the timing signal TM30 similarly enters the counter 110 resulting in the shift of the status of operation.

From the foregoing it is seen that the status-of-operation signals STO, ST1, . . . ST8 and ST9 are developed from the inverter 114, 116, . . . 130 and 132 in the named order to indicate the corresponding statuses of operation for the purpose of generating a command speed pattern as shown in FIG. 2 or 3.

The NAND gates 150 through 168 are of the open collector output type and form the so-called wired OR circuit by supplying an electric source VCC to a resistor 70 connected to the outputs of all the NAND gates.

Figures 10A, 10B, 10C:
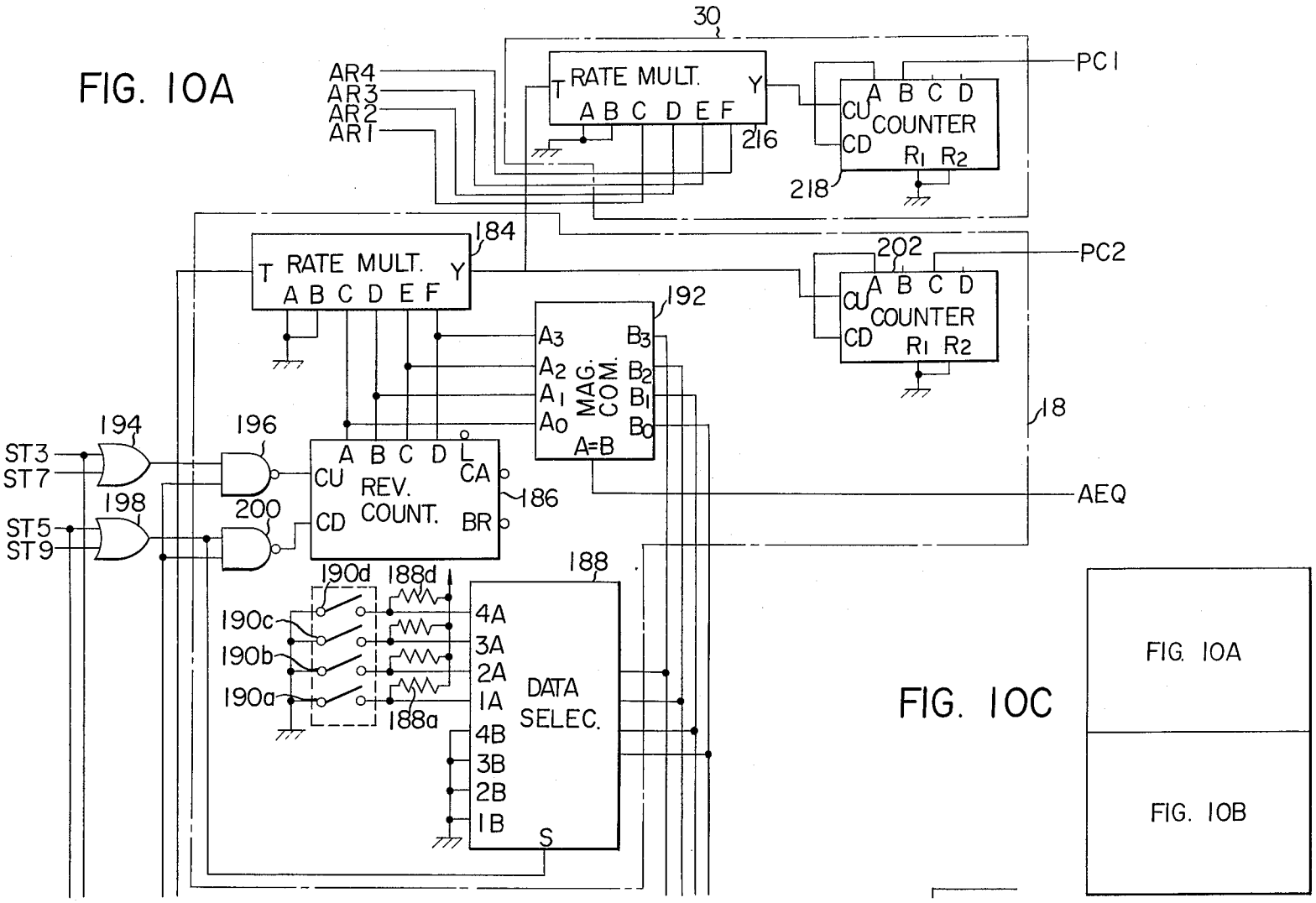
FIGS. 10A and 10B together are a circuit diagram of the basic acceleration block generator and the third modulator with the intermediate components disposed therebetween shown in FIG. 4.
FIG. 10C is a diagram illustrating the arrangement of FIGS. 10A and 10B.
Figure 10B:
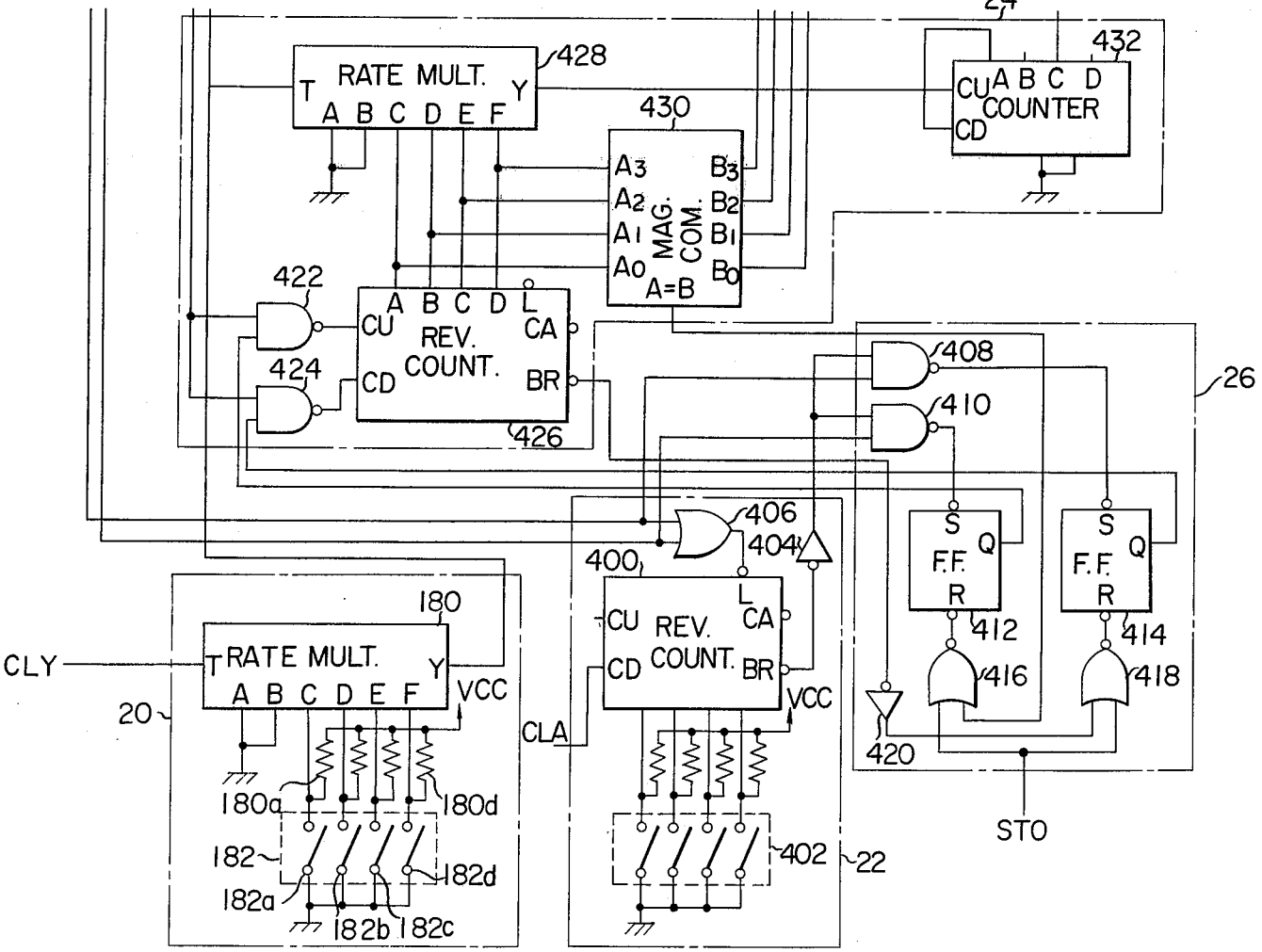
Figure 11:
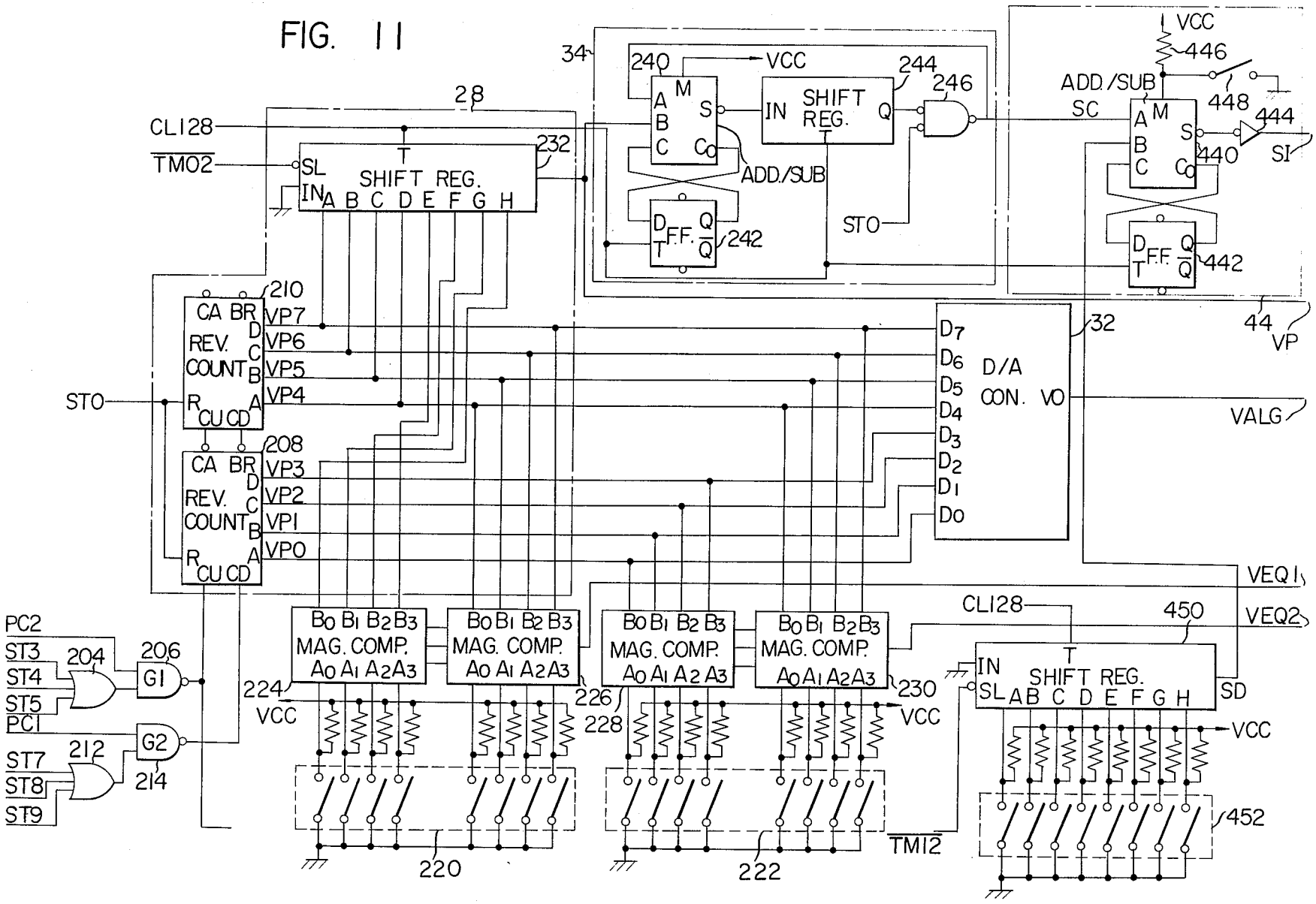
FIG. 11 is a circuit diagram of the first reversible counter and the associated components shown in FIG. 4.

FIGS. 10 and 11 together show the details of the essential circuitry for generating a command speed pattern. The circuitry comprises the basic acceleration clock generator 20, the first modulator 18, the first counter device 28 and the digital-to-analog coverter 32. The basic acceleration clock generator 20 includes a synchronous 6-bit binary rate multiplier 180 such as commercially available under TTL-IC SN7497 from Texas Instruments Incorp. and a switch bank 182 having a plurality, in this case, four of switches 182*a*, 182*b*, 182*c*, and 182*d*. The switches 182*a*, 182*b*, 182*c* and 182*d* are connected at one end to ground and at the other ends to an electric source VCC through respective resistors 180*a*, 180*b*, 180*c* and 180*d* and also to rate inputs, C, D, E and F to the rate multiplier 180 with rate inputs A and B connected to ground. When open, the switches set values of binary ONE at the mating rate inputs and when closed, they set values of binary ZERO at the mating rate inputs because the latter are connected to the electric source VCC through the respective resistors. Thus the rate inputs C, D, E and F to the rate multiplier 180 can have a binary number x as determined by the closure and opening of the switches 182*a*, 182*b*, 182*c*, and 182*d* of the switch bank 182.

For a given rate x, clock pulses CLY with a pulse repetition frequency of f applied to a clock input T to the rate multiplier 180 appears from an output Y thereof as clock pulses CLY' having a pulse repetition frequency of xf/64. Those clock pulses CLY' are shown in FIG. 7 as being the basic operation clock pulses CL128 shown in FIG. 7.

The clock pulses CLY' are successively supplied to the first modulator 18 and strictly, to a 6-bit binary rate multiplier 184 similar to the rate multiplier 180 and including rate inputs C, D, E and F supplied from synchronous a 4-bit binary reversible counter 186 such as commercially available under TTL-TC SN74193 from Texas Instruments Incorp.

The first modulator 18 includes further a quadruple 2-line-to-1-line data selector 188 having one set of four parallel inputs 1B, 2B, 3B and 4B connected to ground and the other set of four parallel inputs 1A, 2A, 3A and 4A connected to a switch bank 190 having four switches 190*a*, 190*b*, 190*c* and 190*b* in the same manner as above described in conjunction with the switch band 182. The data selector 188 may be commercially avaliable, for example, under TTL-IC SN74157 from Texas Instruments Incorp. and is operative to reproduce an input status of the inputs 1A, 2A, 3A and 4A at its parallel outpus 1Y, 2Y, 3Y and 4Y with an selection input S thereof having a value of binary ZERO and an input status of the inputs 1B, 2B, 3B and 4B at the outputs 1Y, 2Y, 3Y and 4Y with the selection input S having a value of binary ONE.

The output from the data selector 188 is compared with an output from the counter 186 by a 4-bit binary magnitude comparator 192 such as marketed under TTL-IC SN7485 from Texas Instruments Incorp.

After the elevator car has been started, the status-of-operation signal ST3 is passed through an OR gate 194 to open a NAND gate 196 in the status of operation 3. Thus clock pulses CLX are successively entered into an UP input CU to the counter 186 through the now opened gate 196. Those clock pulses are formed by frequency dividing the pulse repetition frequency of the basic operation clock pulses CL128 and in this case have a pulse repetition period of 102.4 milliseconds. Under these circumstances, an output from the counter 186 is increased stepwise and the basic acceleration clock pulses CLY' is frequency modulated by the rate multiplier 184. Thus an output from the rate multiplier 184 has a pulse repetition frequency linearly increased from its null magnitude.

On the other hand, since an OR gate 198 has an output of binary ZERO except for the statuses of operations 5 and 9, the data selector 188 has the selection input S put at its level of binary ONE and produces at its parallel outputs 1Y, 2Y, 3Y and 4Y a replica of the input status at the rate inputs 1A, 2A, 3A and 4A as determined by the operation of the switch bank 190. The switch bank 190 has be set to provide a 4-bit maximum acceleration for the car. Therefore the magnitude comparator 192 compares the maximum acceleration from the data selector 188 with a 4-bit count from the counter 186 to generate an equality signal AEQ at the output A = B when the two is equal to each other.

As above described in conjunction with FIG. 9, this equality signal AEQ shifts the operation to the status of operation 4 to stop the operation of the counter 186 and then the occurrence of a stop determination signal DEC results in the shift to a status of operation 5. This permits a status-of-operation signals ST5 to pass through the OR gate 198 to impart to the selection input S to the data selector 188 a binary ONE. Thus the status of the inputs 1B, 2B, 3B, and 4B of the data selector 188 indicating a null acceleration is transferred to the magnitude comparator 192. Also the output of binary ONE from the OR gate 198 opens the NAND gate 200 to permit the clock pulses CLX to successively enter the DOWN input DC of the reversible counter 186. Accordingly, the counter 186 is initiated to count pulses down. Upon the counter 186 providing a null output, the magnitude comparator 192 delivers an equality signal AEQ resulting in the shift to the status of operation 6. At that time the status of operation 6 is immediately shifted to the status of operation 7 because of the presence of the stop determination signal DEC.

In the status of operation 7, a status-of-operation signal ST7 is passed through the OR gate 194 to open the NAND gate 196. This causes the counter 186 to count pulses up. In this case the magnitude comparator 192 compares a count on the counter 186 with a maximum magnitude of an acceleration as preset by the switch bank 190 until an equality signal AEQ is produced by the comparator 192 to shift the status of operation 7 to the next succeeding status 8. At that time the counter 186 terminates to count the pulses up.

When the command speed reaches a magnitude at the time point T5 as shown in FIG. 3, the operation is shifted to a status of operation 9. Then a status-of-operation signal ST9 passes through the OR gate 198 to open the NAND gate 200. Thus the counter 186 again counts the clock pulses CLX down. Upon a count on the counter 186 reaching a null magnitude, the comparator 192 produces similarly an equality signal AEQ whereupon the operation is returned back to the status of operation 0 and also the counter 186 terminates to count the clock pulses CLX down.

In this way the counter 186 produces an output having a waveform equal to the acceleration waveform $OC_1C_2T_3T_3'C_4C_5T_0$ as shown in FIG. 3 and the basic acceleration clock pulses CLY' has a pulse repetition frequency modulated into a similar form by the rate multiplier 184. The pulses from the rate multiplier 184 thus modulated are frequency divided to one sixteenth the original frequency by a 4-bit counter 202 resulting in an acceleration pulsed signal PC2. The counter 202 may be commerically available under TTL-IC SN7493 from Texas Instruments Incorp.

The frequency modulated pulses from the rate multiplier 184 are also applied to the third modulator 30 and strictly to a rate multiplier 216 similar to the rate multipler 184 to be again frequency modulated with a rate as determined by a binary number applied to four rate inputs C, D, E and F of the mulitplier 216 dependent upon a 4-bit acceleration correcting signal AR1, AR2, AR3 and AR4 as will be described hereinafter. Then the frequency modulated signals from the rate multiplier 216 is frequency divided to one fourth its frequency by a 4-bit counter 218 similar to the counter 202. The frequency divided pulse signal from the counter 218 results in an acceleration pulsed signal PC1.

In FIG. 10 the delay time control 22 is shown as including a 4-bit counter 400 similar to the counter 186, a switch bank 402 similar to the switch bank 182, an inverter 404 connected to the counter 400 at the BORROW output BR and an OR gate 406 connected to an input L thereto and applied with the status of operation signals ST3 and ST5. The counter 400 has a binary number preset by the switch bank 402.

The inverter 406 is connected to one input to a pair of NAND gates 408 and 410 included in the acceleration timing memory 26 and having respective outputs connected to set inputs to FLIP-FLOP's 412 and 414. The FLIP-FLOP's 412 and 414 include reset inputs R connected to outputs of NOR gates 416 and 418 respectively. The NOR gate 416 includes one input applied with the status-of-operation signal STO while the NOR gate 418 includes one input also applied with the signal STO and the other input connected to an output of an inverter 420. The NAND gates 408 and 410 include the other inputs applied with the status-of-operation signals ST5 and ST3 respectively.

The second modulator 24 comprises a pair of NAND gates 422 and 424 including one input applied with clock pulses CLX and the other inputs connected to the outputs Q of the FLIP-FLOP's 412 and 414 respectively.

Both gates 422 and 424 include outputs connected to an UP and a DOWN input CU and CD to a reversible counter 426 similar to the counter 186. The counter 426 includes a BORROW output BR connected to an input to the inverter 420 and four parallel outputs A, B, C, and D connected to four parallel input C, D, E, and F to a rate multiplier 428 similar to the rate multiplier 180 and havng applied thereto the basic acceleration clock pulses CLY' from the rate multiplier 180. The four outputs A, B, C and D of the counter 426 are also connected to one set of four inputs $A_0$, $A_1$, $A_2$ and $A_3$ to a magnitude comparator 430 similar to the magnitude comparator 192. The rate multiplier 428 is connected at the output Y to an UP input CU to a counter 432 similar to the counter 202 and the magnitude comparator 430 includes the other set of four inputs $B_0$, $B_1$, $B_2$ and $B_3$ connected to the outputs 1Y, 2Y, 3Y and 4Y of the data selector 188 respectively.

Except for the statuses of operation ST3 and ST5, the OR gate 406 has its output put at its level of binary ZERO, and the counter 400 has the 4-bit binary number preset by the switch bank 402. When the status of operation 3 is entered, the OR gate 204 provides the output of binary ONE. Therefore, each time the clock pulse CLA is applied to the DOWN input CD thereto, the counter 400 counts the preset number down until it is cleared. At that time the output BR of the counter 400 delivers a borrow pulse of binary ZERO. As the NAND gate 410 is in its open state in the status of operation ST3, the borrow pulse passes through the inverter 404 and the NAND gate 410 to set the FLIP-FLOP 412 which has been preliminarily reset with the status-of-operation STO applied thereto through the NOR gate 416 during the status of operation STO. Thus the output Q of the FLIP-FLOP 412 applies an output to the NAND gate 422.

Under these circumstances, the clock pulses CLX are successively passed through the NAND gate 422 to be applied to the reversible counter 426 at the UP input CU. Thus a 4-bit output at the outputs A, B, C, and D of the counter 426 is stepwise increased and the basic acceleration clock pulses CLY' from the rate multiplier 180 are frequency modulated by the rate multiplier 428 to be linearly increased in frequency from a null magnitude modulated pulses or frequency divided to one eighth the original frequency by the counter 432 resulting in an acceleration pulsed signal PC3.

On the other hand, the data selector 188 delivers a replica of 4-bit number at the inputs 1A, 2A, 3A, and 4A because an associated car is not in either of the statuses of operation ST3 and ST5. Accordingly the magnitude comparator 430 compares the 4-bit output from the counter 426 with the 4-bit maximum acceleration from the data selector 188 as determined by the switch bank 190. When both outputs equal each other, the magnitude compartor 430 delivers an equality output of binary ONE to the NOR gate 416 from the output A=B. This equality output is passed through the NOR gate 416 and entered into the FLIP-FLOP 412 to reset it. The resetting of the FLIP-FLOP 412 terminates the counting-up of the counter 426 to hold the maximum acceleration at the output thereof.

Then the status of operation ST5 is eraced. In the status of operation ST5, an output of binary ONE from the OR gate 406 releases the counter 400 from its preset state to set the FLIP-FLOP 414 previously reset with the state-of-operation signal STO in the similar manner as above described in conjunction with the FLIP-FLOP 412. Therefor the clock pulses CLX are entered through the now opened NAND gate 424 to the DOWN input CD to the counter 426. The counter similarly performs the counting-down operation to provide an output stepwise decreased. Then basic acceleration clock pulses CLY' from the rate multiplier 180 are frequency-modulated by the rate mulitplier 428 as above described but the frequency thereof is linearly decreased to its null magnitude. Those frequency divided pulses are frequency divided by the counter 432 in the same manner as above described resulting in an acceleration pulsed signal PC3.

When the counter 426 provides an output of binary ZERO, the borrow output of binary ZERO herefrom is passed through the inverter 420 and the NOR gate 412 to reset the FLIP-FLOP 414. The resetting of the FLIP-FLOP 414 causes the closure of the NAND gate 424 to suspend the counting down of the counter 426.

In this way the basic acceleration clock pulses CLY' are frequency modulated into the trapezoid $T_0D_1D_2T_p$ as shown at dotted line in FIG. 3.

In FIG. 11 an OR gate 204 includes three inputs adapted to be applied with the status-of-operation signals ST3, ST4, and ST5 respectively and an output connected to one input to a NAND gate 206 including the other input applied with the acceleration pulsed signal PC2 from the counter 202 (FIG. 10). Also another OR gate 212 having the status-of-operation signals ST7, ST8, and ST9 applied thereto includes an output connected to one input to an NAND gate 214 including the other input supplied with the acceleration pulsed signal PC1 from the counter 218 (FIG. 10A). The OR gate 204 and the NAND gate 206 from the gate means G1 shown in FIGS. 4 and 5 while the OR gate 212 and the NAND gate 214 from the gate means G2 shown in FIGS. 4 and 5. Both NAND gates 206 and 214 includes outputs connected to a reversible counter 208 at the UP and DOWN inputs CU and CD respectively. The counter 208 is similar to the counter 186 shown in FIG. 10.

In the statuses of operation ST3, and ST4 and ST5 the acceleration pulsed signal PC2 frequency modulated by the rate multiplier 184 is applied through the NAND gate 206 to the UP input CU to the counter 208. IN the statuses of operation ST7, ST8 and ST9, the acceleration pulsed signal PC1 frequency modulated twice by the rate multipliers 184 and 216 are applied to the DOWN input CD to the counter 208. The counter 208 includes a pair of outputs CA and BR connected to an UP input CU and DOWN input CD to another reversible counter identical to the former to form a first reversible counter including eight bit positions. Each of counters 208 and 210 include a reset input R applied with the status-of-operation signal STO.

As a result, the first counter 208-210 produces an 8-bit binary output representing the command speed pattern such as shown by $OA_1A_2A_3PA_3'A_4A_5T_6$ in FIG. 3. This 8-bit binary output is supplied to the degital-to analog coverter 32 shown in FIG. 11 as being of an 8-bit type including eight parallel inputs $D_0$ through $D_7$, In the converter 32 the 8-bit input is converted to a corresponding analog signal VALG that is developed at its output VO.

The first counter devices 28 further includes a pair of switch banks 220 and 222 each including a plurality, in this case, eight of switches connected to an associated magnitude comparator and an electric source in the similar manner as above described in conjunction with the switch bank 182. The switch bank 220 is operative to determine that magnitude of the command speed at a point or the time point $T_2$ (see FIG. 3) where the acceleration is initiated to decrease in order to prevent the actual speed from exceeding its rated speed during the operation reaching the rated speed. The magnitude of the command speed as determined by the switch bank 220 is applied to eight parallel A inputs to an 8-bit magnitude comparator shown in FIG. 11 as being formed of two serially connected, 4-bit magnitude comparators 224 and 226 each similar to the magnitude comparator 192. The 8-bit comparator 224–226 compares the 8-bit output from the counter 208–210 at B inputs thereof with the command speed just described to produce at its output A = B a signal VEQ1 for shifting the operation from the state 4 to 5 in response to the output from the counter equaling the command speed.

On the other hand, the switch bank 222 is operative to determine that magnitude of the command speed at the time point $T_5$ (see FIG. 3) where the acceleration is initiated to decrease during the deceleration. This magnitude of the command speed is applied to eight parallel A inputs to an 8-bit magnitude comparator shown in FIG. 11 as being formed of two serially connected 4-bit magnitude comparators 228 and 230 each similar also to the magnitude comparator 192. The 8-bit comparator 228–230 compares the 8-bit output from the counter 208–210 with the command speed resulting from the switch bank 222 to produce at its output A = B a signal VEQ2 for shifting the operation from the status 8 to 9 when the output from the counter equals the command speed.

The 8-bit output labelled VP0 through VP7 from the counter 208–210 is also supplied to an 8-bit shift register 232 such as commercially available under TTL-IC SN74166 from Texas Instruments Incorp. The shift register 232 includes eight parallel inputs A through A applied with eight bits VP7 through VP0 of the output form the first counter 208–210 respectively, a loading input SL for parallel signal applied with a timing signal $\overline{TMO2}$ (see FIG. 7) and a clock input T applied with the basic operation clock pulses CL128. When the loading input SL has a value of binary ZERO, data applied to the parallel inputs A through H are registered or loaded in the shift register 232 and eight bits of a corresponding command speed signal are serially developed at the output Q of the register 232 for a time interval between the time slots 3 and 10 of the fundamental operating period (see FIG. 7) one for each time slot. This command speed signal forms a series command speed signal VP which represents the content of the counter 208–210.

This series command speed signal VP is integrated into a distance signal SI by the integrator 34 (see FIG. 4). In order to calculate the residual distance to a desired floor, the command speed signal is required to be expressed in the same unit as the series actual position signal SP from the shift register 86 for the actual position as shown in FIG. 8.

In the example illustrated, the basic acceleration pulses CLY' from the rate multiplier 180 have a pulse repetition frequency $f_o$ as determined of itself by the fundamental operating period, the rated speed $V_{max}$ in meters per second, a magnitude ΔS in meters of each positional pulse 60*a* or 60*b* from the pulse generator 60 (see FIG. 8) calculated in terms of a distance (which generator senses a distance of movement of the elevator car), a maximum amplitude $A_{max}$ in meter per second per second of a command acceleration pattern, and a rate of acceleration's change J in meters per second per second per second with respect to time. For example, it is assumed that the rated speed $V_{max}$, the maximum acceleration $A_{max}$, the rate of acceleration change J and the distance ΔS corresponding to each positional pulse have respectively following magnitudes:

$$V_{max} = 300 \text{ m/min} = 5 \text{ m/sec}, A_{max} = 1 \text{ m/sec}^2,$$

$$J = 1 \text{ m/sec}^3$$

and $$\Delta S = 5 \times 10^{-3} \text{ m}.$$

It is also assumed that the clock pulses CLX counted by the counters 186 and 428 (FIG. 10) have a pulse repetition period of 102.4 milliseconds resulting from the frequency division of the basic operation clock pulses CL128 and that the switch bank 190 sets a maximum magnitude of 10 of the acceleration on the data selector 188. Under the assumed condition, a command acceleration pattern such as shown by $OC_1C_2T_3$ or $T_0D_1D_2T_p$ in FIG. 3 has a maximum acceleration of substantially 1 m/sec$^2$ and a rate of accelerations change of about 1 m/sec$^3$. It will now be tried to seek for the pulse repetition frequency $f_o$ of the basic acceleration pulses CLY' under the conditions as above described.

Since it is assumed that the positional pulse 60*a* or 60*b* (see FIG. 8) has a pulse repetition frequency of 1,000 hertzs during the travel at the rated speed. Also assuming that a distance correction SC is null that is, SC = SI only for purposes of simplification and that the series command speed signals VP applied to the integrator 36 has also the least significant position of binary numbers in the time slot 13, the number of the series distance-of-movement signals SI from the integrator 34 must increase with increments of 1,000 per second. Accordingly the series command speed signals VP require the content corresponding to 0.2 in view of the fundamental operating period of 200 microseconds.

On the other hand, the first counter 208–210 is required to deliver a binary number approximating a maximum decimal number 255 or a binary number 11111111 during the travel at the rated speed in order to efficiently operate the counter 208–210. Accordingly converting the 8-bit command speed signal from the counter 208–210 to a series binary signal within the fundamental operating period requires only a time interval between the time slot 3 and the time slot 10.

Where binary numbers have the least significant position in the time slot 13, the time slot 3 is a bit position corresponding to $2^{-10}$. This means that, during the travel at the rated speed the 8-bit output from the counter 208–210 has a content of $0.2/2^{-10} \approx 205$. This figure is equal to the number of the pulses entering the counter 208–210 until the command speed reaches its rated magnitude.

From the foregoing it is seen that, by considering that the rate multiplier 180 has a rate of frequency conversion of 10/16 and the the counter 202 has a ratio of frequency division of 1/8 for adjusting the spacing between adjacent pulses from the rate multiplier 180, the basic acceleration pulses CLY' have a pulse repetition frequency of $f_o$ satisfying $$0.2/2^{-10} = f_o \times (V_{max}/A_{max}) \times 10/16 \times 1/8$$

That is, $f_o$ is about 524 hertzs.

Assuming that the clock signal CLY is formed of clock pulses with a pulse repetition frequency of 625 hertzs provided by frequency dividing the basic operation clock pulses CL128, the parallel inputs C, D, E and F of the rate multiplier 180 for determining the pulse repetition frequency of the basic acceleration pulses have applied thereto a rate of frequency conversion AC calculated at $$AC \approx 13$$

This is because $$f_o = 4AC/64 \times 625$$

This figure can readily be set by the associated switch bank 182. It will readily be understood that the frequency $f_o$ of the basic acceleration pulses can increase in accuracy by increasing the number of bits of the rate of frequency conversion or the number of the parallel inputs to the rate multiplier 180 with the number of the switches of the switch bank 182 increased correspondingly.

FIG. 11 illustrates also the details of the integrator 34, and the distance corrector 44. The integrator 34 includes a full adder 240, a D FLIP-FLOP 242 and a 32-bit shift register 244 similar in both construction and connection to the full adder/subtracter 80, the D FLIP-FLOP 82 and the shift register 86 shown in FIG. 8 respectively excepting that in FIG. 11, the shift register 244 has the output Q returned back to the addition input A of the adder 240 through a NOR gate 246 with the selection input M connected to the source VCC. The basic operation clock pulses SL128 are successively applied to the clock inputs T of the FLIP-FLOP 242 and the shift register 244. The adder 242 acts as a 1-bit series adder and also forms a series 32-bit integrator circuit with the D FLIP-FLOP 242, the shift register 244 and the NOR gate 246 because of the presence of the feedback circuit with the NOR gate 246.

The series command speed signal VP from the shift register 232 is applied to the adder 242 at the addition input B to be integrated into a distance-of-movement signal SC that is in turn to be developed at the output Q of the register 244. The distance-of-movement signal SC represents a theoretical distance of movement of the car dependent upon the command speed pattern.

The distance corrector 44 having that distance-of-movement signal SI includes a full adder/subtracter 440 and a D FLIP-FLOP 442 similar in both construction and connection to the full adder/subtracter 80 and the D FLIP-FLOP 82 as shown in FIG. 8 34 and an inverter 444 connected to the adder/subtracter 440 at the output S. The adder/subtracter 440 has its addition/subtraction SELECTION input M connected to the source VCC through a resistor 446 and also to ground to a normally open switch 448. With the switch 448 maintained in its open position the adder/subtracter 440 effects the addition by having the selection input M put at its level of binary ONE, while with the switch 448 put in its closed position to put the selection input M at its level of binary ZERO, the adder/subtracter 440 functions as an adder. The basic operation clock pulses CL128 a is applied to the clock input T to the D FLIP-FLOP 442 and a distance correction signal SD to the addition/subtraction input B to the adder/subtracter 440.

In order to apply the distance correction signal SD to the distance corrector 44, an 8-bit shift register 450 similar to the shift register 232 includes an output Q connected to the addition/subtraction input B to the adder/subtracter 440. Eight parallel inputs A through H to the shift register 450 are connected to a switch bank 452 also similar to the switch bank 220 in the same manner as the latter. An 8-bit binary number as determined by the closure and opening of respective switches of the bank 452 is applied to the parallel inputs A through H to the shift register 450 having the basic operation clock pulses CL128 applied to the clock input T and delivered to the input B to the adder/subtracter 440 as a serial distance correction signal SD having the least significant position in the time slot 13 of the basic operating period.

From the foregoing it will be appreciated that, upon storing the relationship between the speed and the distance of movement during the acceleration, the switch 448 is put in its open position to add a predetermined distance correction SD to the theoretical distance of movement SC in the adder/subtracter 440 acting as an adder. On the other hand, when the distance correction SD is to be subtracted from the distance of movement SC, the switch 448 is put in its closed position to operate the adder/subtracter 440 as an subtracter.

In this way the output S of the adder/subtracter 440 provides a theoretical distance-of-movement signal $\overline{SI}$ to be stored which, in turn, passes through the inverter 444 resulting an inversed theoretical distance-of-movement signal SI.

Figure 12A:
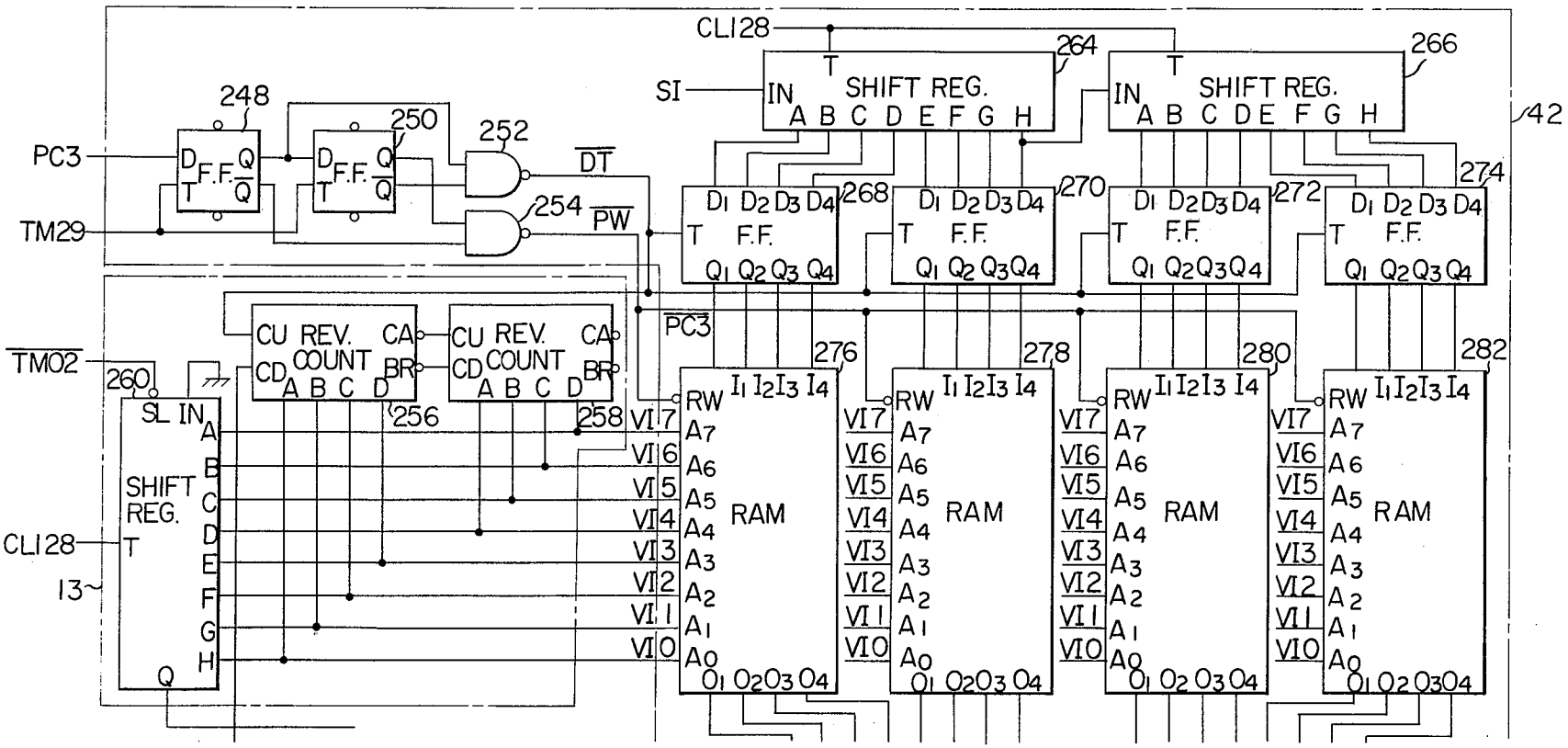
FIGS. 12A and 12B together are a circuit diagram of the distance-of-movement memory and the associated components shown in FIG. 4.
Figure 12B:
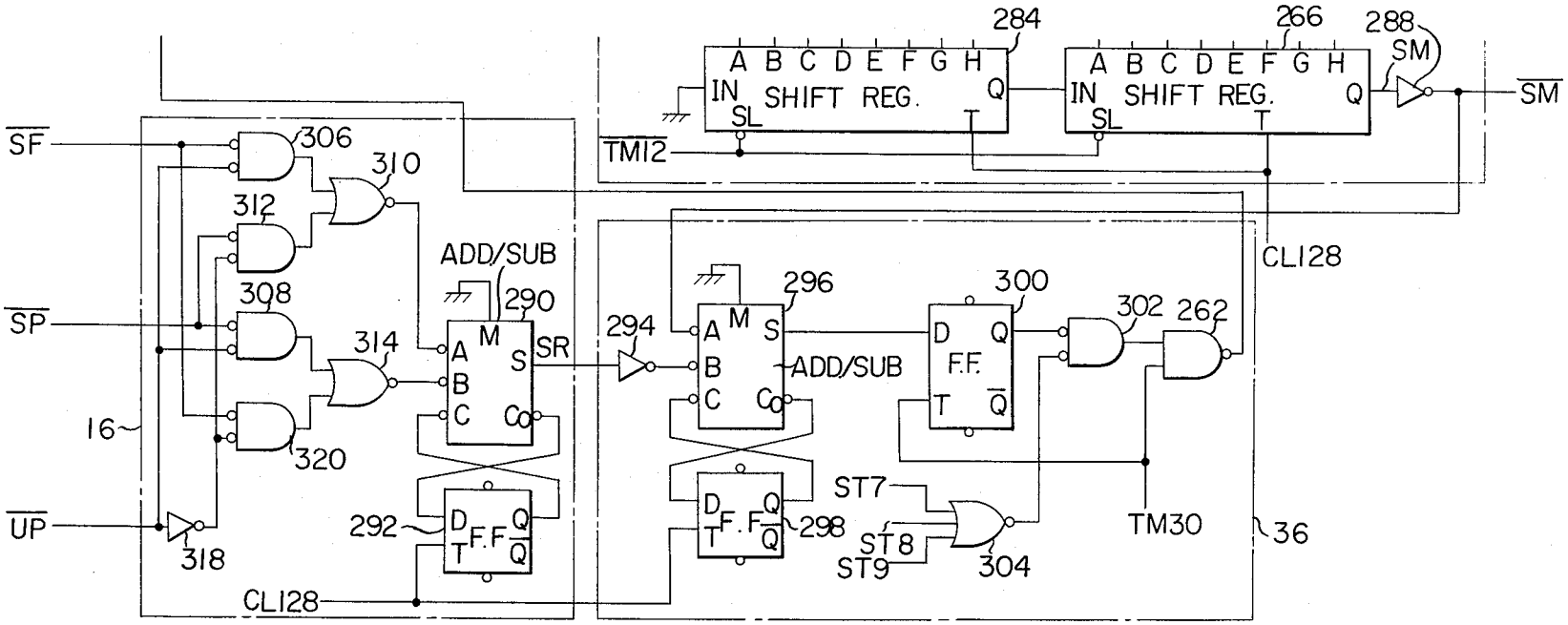
Figure 12C:
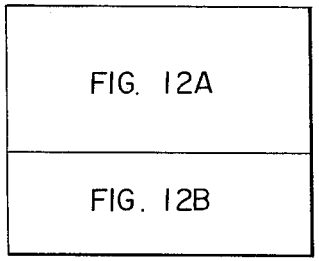
FIG. 12C is a diagram illustrating the arrangement of FIGS. 12A and 12B.

FIG. 12 shows the details of the second counter device 38, the distance-of-movement memory 42, the distance comparator 36 and the subtracter 16 illustrated in FIG. 4. In FIG. 12 the distance-movement memory 42 is shown as including a pair of D FLIP-FLOP's 248 and 250 and a NAND gate 252 similar in both construction and connection to the D FLIP-FLOP's 64 and 66, a NAND gate 252 and another NAND gate 254. Both NAND gates 252 and 254 include one input having both inputs connected to the outputs Q and $\overline{Q}$ respectively of the FLIP-FLOP's 248 and 250 and the other inputs connected to the outputs $\overline{Q}$ and Q respectively of the FLIP-FLOP's 250 and 248.

The pulsed signal PC3 from the counter 432 (see FIG. 10) is applied to the input D of the FLIP-FLOP 248 triggered with the timing signal TM29 applied to the clock inputs T to the FLIP-FLOP's 248 and 250 to provide a pulsed signal $\overline{PT}$ at the output of the NAND gate 252 and at the rise of the signal PC3 in synchronization with the timing signal TM29. The pulse signal $\overline{PT}$ has a pulsewidth corresponding to the fundamental operating period. The pulse signals $\overline{PT}$ are successively applied to the second counter device 38, that is to an UP input CU to a second 8-bit reversible counter formed of a pair of 4-bit reversible counters 256 and 258 similar to the 4-bit reversible counters 208 and 210 (see FIG. 11) respectively and counted up. Therefore the second counter 256–258 is identical in output to the first counter 208–210 in an acceleration region or in the statuses of operation 3,4 and 5.

Further the timing pulses $\overline{TM02}$ and the basic operation clock pulses CL128 are successively applied to a loading input SL and a clock input T to an 8-bit shift register 260 identical to the shift register 232 (see FIG. 11) while an 8-bit parallel output from the second counter 256–258 is applied to eight parallel inputs A through H thereto to provide at an output Q thereof a second serial command speed signal VI having the least significant position in the time slot 13 of the fundamental operating period.

On the other hand, the distance-of-movement signal SI from the inverter 444 is supplied to an input IN to an 8-bit shift register 264 included in the distance-of-movement memory 42. The shift register 264 may be commercially available under TTL-IC SN74164 from Texas Instruments Incorp. and includes eight parallel output A through H with the output H connected to an input IN to a similar shift register 266. The registers 264 and 266 have respective clock inputs T successively applied with the basic operation clock pulses CL128 and cooperate with each other to convert the series signal SI to a corresponding 8-bit parallel signal having the least significant position in the time slot 13. As shown in FIG. 12, four quadruple D FLIP-FLOP's 268, 270, 272 and 274 such as marketed under TTL-IC SN74175 from Texas Instruments Incorp. are connected to the shift registers 264 and 266 two for each register and the pulse signal $\overline{PT}$ from the NAND gate 252 synchronized with the timing signal TM29 is applied to clock inputs T to the four FLIP-FLOP's to hold the 16-bit parallel signal therein.

The FLIP-FLOP's 268, 270, 272 and 274 are connected in 4-bit parallel relationship to an array of 4-bit, 256 word static random access memories, 276, 278, 280 and 282 respectively. Each of those memories (which is abbreviated hereinafter to "RAM") includes a control input RW for controlling writing-in and reading-out so that, with the input RW having a value of binary ZERO, four bits applied to four inputs $I_1$, $I_2$, $I_3$ and $I_4$ from the outputs $Q_1$, $Q_2$, $Q_3$ and $A_4$ of the associated FLIP-FLOP's are simultaneously written therein at an address as defined by eight address bits VI0 through VI7 supplied to eight address inputs $A_0$ through $A_7$ from outputs of the second counter 256-258. In order to put the control input RW at its level of binary ZERO, a pulse signal $\overline{PW}$ is produced at the output of the NAND gate 254 at the fall of the pulse signal $\overline{PW}$ and in synchronization with the timing signal TM29. The pulse signal $\overline{PW}$ thus produced has a pulsewidth corresponding to the fundamental operating period and is applied to the control input RW to each other RAM". With the control input RW having a value of binary ONE, data stored at their address in each RAM can be read out through four-parallel outputs $O_1$, $O_2$, $O_3$ and $O_4$ one for each output.

From the foregoing it will be appreciated that in the statuses of operation 3, 4 and 5 the array of the four RAM's 276, 278, 280 and 282 stores a 16-but parallel distance-of-movement signal held in the four FLIP-FLOP's 268, 270, 272 and 274 at its address as determined by the output from the second counter 256–258 each time the second counter counts one pulse up. As a result, the array of the RAM's stores the relationship between the command speed and the distance of movement in the form of a speed-to-distance function.

The outputs $O_1$, $O_2$, $O_3$ and $O_4$ of the RAM's 276 and 278 are connected to eight parallel inputs A, B, C, E, F, G and H to an 8-bit shifter register 284 while the outputs of the RAM's 280 and 282 are similarly connected to a similar shift register 286 serially connected to the shift register 284. The shift register 286 is connected at the output Q to an inverter 288.

In FIG. 12, the subtracter device 16 is shown as including a series subtracter formed of subtracter 290 and a D FLIP-FLOP 292 similar in both construction and connection to the adder/subtracter 80 and the FLIP-FLOP 82 as shown in FIG. 8 excepting that in FIG. 12 the selection input M is connected to ground.

Also the distance comparator 36 is shown in FIG. aa as including an inverter 294, a series subtracter 296–298 identical to the series subtracter 290–292 and having a subtraction input B connected to the output of the inverter 294. The subtracter 296 is connected at the opration output S to an input to a D FLIP-FLOP 300 including an output Q connected to one input to a NOR gate 302. The other input to the gate 302 is connected to an output of a NOR gate 304. The NOR gate 302 includes an output connected to one input to NAND gate 262 having the other input applied with the timing signal TM30. This timing signal also is applied to a clock input T of the FLIP-FLOP 300.

During the upward travel of the elevator car, an UP travel signal $\overline{UP}$ has a value of binary ZERO and is applied to NOR gates 306 and 308 to open them. On the other than, a stop floor signal $\overline{SF}$ is passed through the now opened gate 306 and thence to NOR gate 310 until it enters to an input A to the subtracter 290. The stop floor signal $\overline{SF}$ is produced by the stop determination device 14 (see FIG. 4) to form a binary floor position signal in the form of 32 series bits indicating a distance between a reference floor such as the lowermost floor and that floor at which the car has been determined to be stop and having the least significant position in the time slot 13. That distance is expressed in terms of the number of unit position pulses. Also the actual position signals $\overline{SP}$ is applied to the NOR gate 308 to open it and then passed through a NOR gate 314 to the input B to the subtracter 290. The clock pulses CL128 is applied to the clock input T to the FLIP-FLOP 292 while the subtracter 290 subtracts the actual position signal $\overline{SP}$ from the stop floor signal $\overline{SF}$ to produce at the operation output S a residual distance signal SR indicating a residual distance to the desired stop floor.

During the downward travel, the UP travel signal $\overline{UP}$ has a value of binary ONE and therefore opens the NOR gate 312 and another NOR gate 320 through an inverter 318. This permits the actual position and stop floor signals $\overline{SP}$ and $\overline{SF}$ to enter the inputs A and B to the subtracter 290 respectively. The subtracter 290 subtracts the signals $\overline{SP}$ from the signals $\overline{SF}$ but it is noted that the subtracter 290 is designed and constructed such that an output therefrom has always a positive value.

Upon the elevator car entering the deceleration region or the statuses of operation 7, 8 and 9, the UP signal $\overline{PT}$ counted up by the second counter 256–258 becomes binary ONE whereupon that counter terminates the counting-up. At the same time, the control inputs RW to the RAM's 276, 278, 280 and 282 becomes a binary ONE to put the RAM's in the read-out mode of operation. Then the 16-bit parallel distance-of-movement signal last stored at its address as determined by the 8-bit speed signal VI formed of the last outputs VI0, VI2, VI3, VI4, VI5, VI6 and VI7 delivered from the second counter 256-258 and in the acceleration region or the status of operation 5 is read out through the outputs $O_1$, $O_2$, $O_3$ and $Q_4$ of each RAM of the array and supplied in parallel relationship to a pair of serially connected 8-bit shift registers 284 and 286 having the basic operation clock pulses CL128 and the timing signals $\overline{TM12}$ applied thereto. In the serially connected shift registers 284 and 286 the 16-bit parallel distance-of-movement signal is converted to a 16-bit series signal SM by means of the timing signal $\overline{TM12}$, the 16-bit series signal having the least significant position in the time slot 13 of the fundamental operating period. This series signal from the output Q of the shift register 286 is applied to the inverter 288 and developed as a stored series distance-of-movement signal $\overline{SM}$ at its output.

This signal $\overline{SM}$ is applied to the input A to the subtracter 296, while the residual distance $\overline{SR}$ is applied to the input B thereto as above described. Thus a difference signal between both signal $\overline{SM}$ and $\overline{SR}$ appears at the operation output S of the subtracter 296.

Since the signal $\overline{SR}$ is larger than the signal $\overline{SM}$ at first, the subtracter 296 provides negative signals at the output S thereof. Further this signal is of a very large binary number sufficient to have values of binary ONE at all bit positions up to the most significant position. Therefore the timing signal TM30 appearing in the time slot 30 of the fundamental operating period is applied to the clock input T to the FLIP-FLOP 300 to trigger it whereby a value of binary ONE appears at the output Q of the FLIP-FLOP 300.

On the other hand, once the signal $\overline{SR}$ becomes smaller than the signal $\overline{SM}$, the subtracter 296 provides a positive binary number at its output S. This binary number is small enough to have values of binary ZERO at all upper bit positions thereof, and therefore the FLIP-FLOP 300 immediately provides a value of binary ZERO at the output Q thereof.

Simultaneously, the status-of-operation signals ST7, ST8 and ST9 passed through the NOR gate 304 can open the NOR gate 302 in the deceleration region. The signal $\overline{SR}$ smaller than signal $\overline{SM}$ causes the gate 302 to provide a value of binary ONE at the output thereby to open the NAND gate 262. The opening of the NAND gate 262 permits the timing signal TM30 to pass to the DOWN input CD to the second counter 256–258 therethrough. This results in the counting-down operation of the second counter 256–258.

From the foregoing it is seen that, each time the signal $\overline{SR}$ becomes smaller than signal $\overline{SM}$, the second counter 256–258 is initiated to count pulses down with the result that the second counter 256–258 produces an ideal speed relative to a corresponding residual distance to the particular stop floor, following the relationship between the distance and speed stored in the array of RAM's 276, 278, 280 and 282. In other words, the output from the second counter 256–258 forms an ideal command speed for the elevator car.

Figure 13:
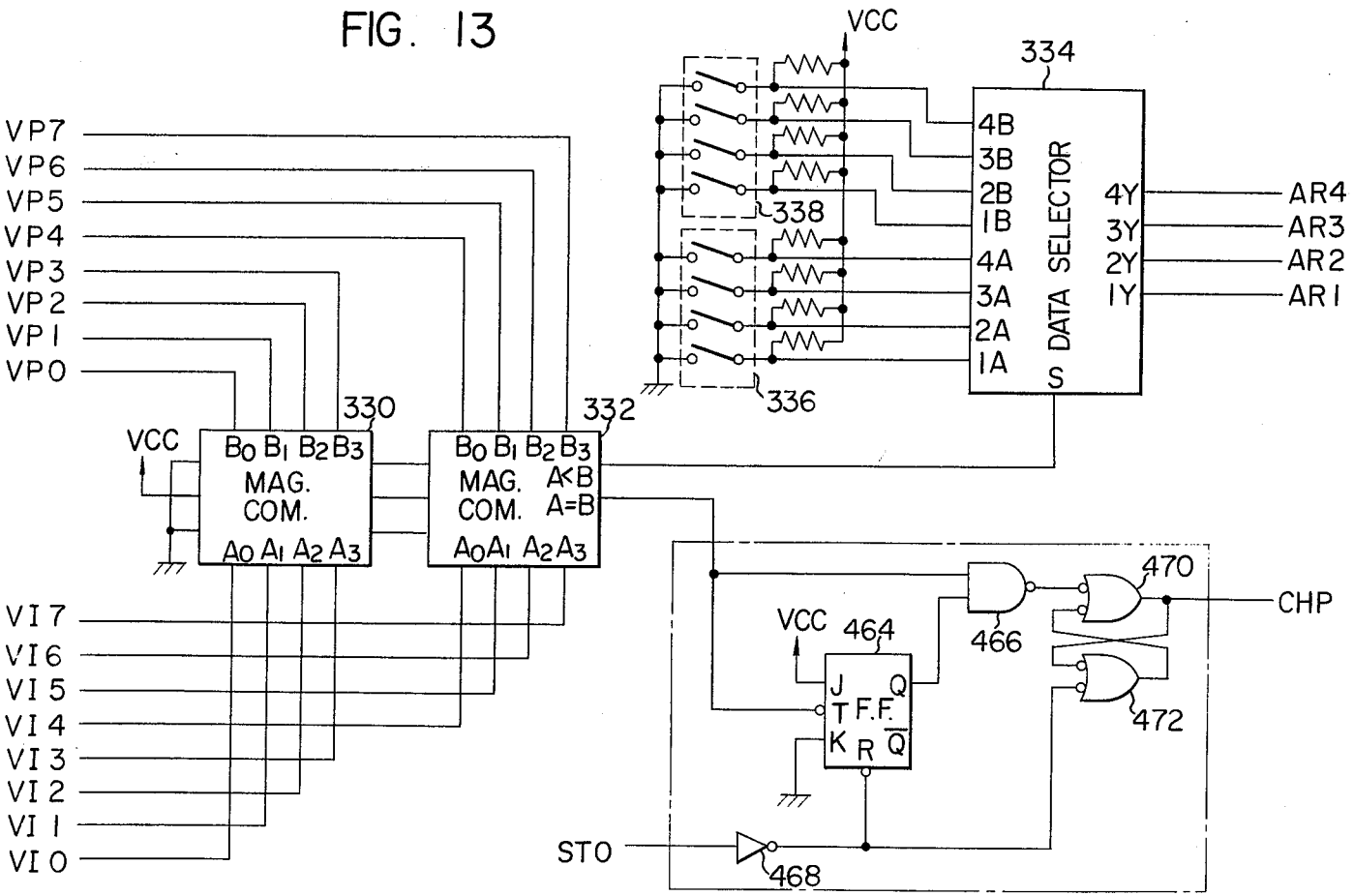
FIG. 13 is a circuit diagram of the speed comparator shown in FIG. 4 and one portion of the command speed selector shown in FIG. 5.

FIG. 13 shows the details of the speed comparator 40 as shown in block form in FIG. 5. In FIG. 13 a pair of 4-bit magnitude comparators 330 and 332 similar to the magnitude comparator 192 (see FIG. 10) are connected in cascade to each other to form an 8-bit parallel comparator. This comparator includes eight B inputs labelled $B_0$, $B_1$, $B_2$ and $B_3$ and applied with 8 bits VP0, through VP7 of the command speed signal VP from the first counter 208–210 and eight A inputs labelled $A_0$, $A_1$, $A_2$ and $A_3$ and applied with eight bits VI0 through VI7 of the second command speed signal VI provided from the second counter 256–258 and also stored in the array of RAM's 276, 278, 280 and 282. Thus the bits at the A inputs are compared with those at the B inputs. The comparator 332 includes one output $A < B$ connected to a selection inputs to a quadruple 2-line to 1 line data selector 334 similar to the data selector 188 (see FIG. 10) and the other output $A = B$.

The selector 334 includes one set of four inputs 1A, 2A, 3A and 4A connected to a switch bank 336 in the same manner as the inputs 1A, 2A, 3A and 4A to the data selector 188 (FIG. 10) and the other set of four inputs 1B, 2B, 3B and 4B similarly connected to another switch bank 338. The switch bank 336 is operative to preliminarily set at the inputs 1A, 2A, 3A and 4A to the selector 334 a binary number $A_S$ less than a binary number 1000 (or a decimal number 8) while the switch bank 338 preliminarily sets at the inputs 1B, 2B, 3B and 4B thereto a binary number $A_L$ larger than the binary number 1000. This is because 4-bit binary numbers have the central value of decimal 8.

With a value of binary ZERO applied to its selection input S, the selector 334 selects the binary number $A_S$ put at the inputs 1A, 2A, 3A and 4A while, with a value of binary ONE applied to the selection input S, it selects the binary number $A_L$ put at the inputs 1B, 2B, 3B and 4B.

More specifically, where the command speed is larger than the stored speed, is to say, where output from the first counter is larger than that from the second counter, a binary ONE is developed from the output A < B of the comparator 332. Therefore the data selector 334 selects the binary number $A_L$ less than the central value of 4-bit binary numbers to deliver it to the rate multiplier 216 (see FIG. 10) as an acceleration rate signal AR formed of four bits AR1, AR2, AR3 and AR4.

Referring back to FIG. 1o, the rate signal AR1, AR2, AR3 and AR4 at the inputs C, D, E and F to the rate multiplier 216 in this case is made larger than the central value to increase the frequency of the output pulses developed at the output Y of the multiplier 216 with the result that the command speed from the first counter 208-210 has a sharper slope.

On the contrary, if the command speed is less than the stored speed, then the selector 334 selects the binary number $A_s$ less than the central value to deliver it to the rate mutliplier 216. This means that the output pulses from the rate multiplier 216 decreases in frequency with the result that the command speed from the first counter 208–210 decreases in slope.

In this way the command speed from the first counter is always compared with the ideal speed from the second counter 256–258 in the deceleration region until a desired stop floor is reached. According to the result of the comparison, the command acceleration is modified to cause the command speed to follow up the ideal speed from the second counter.

Figure 14:
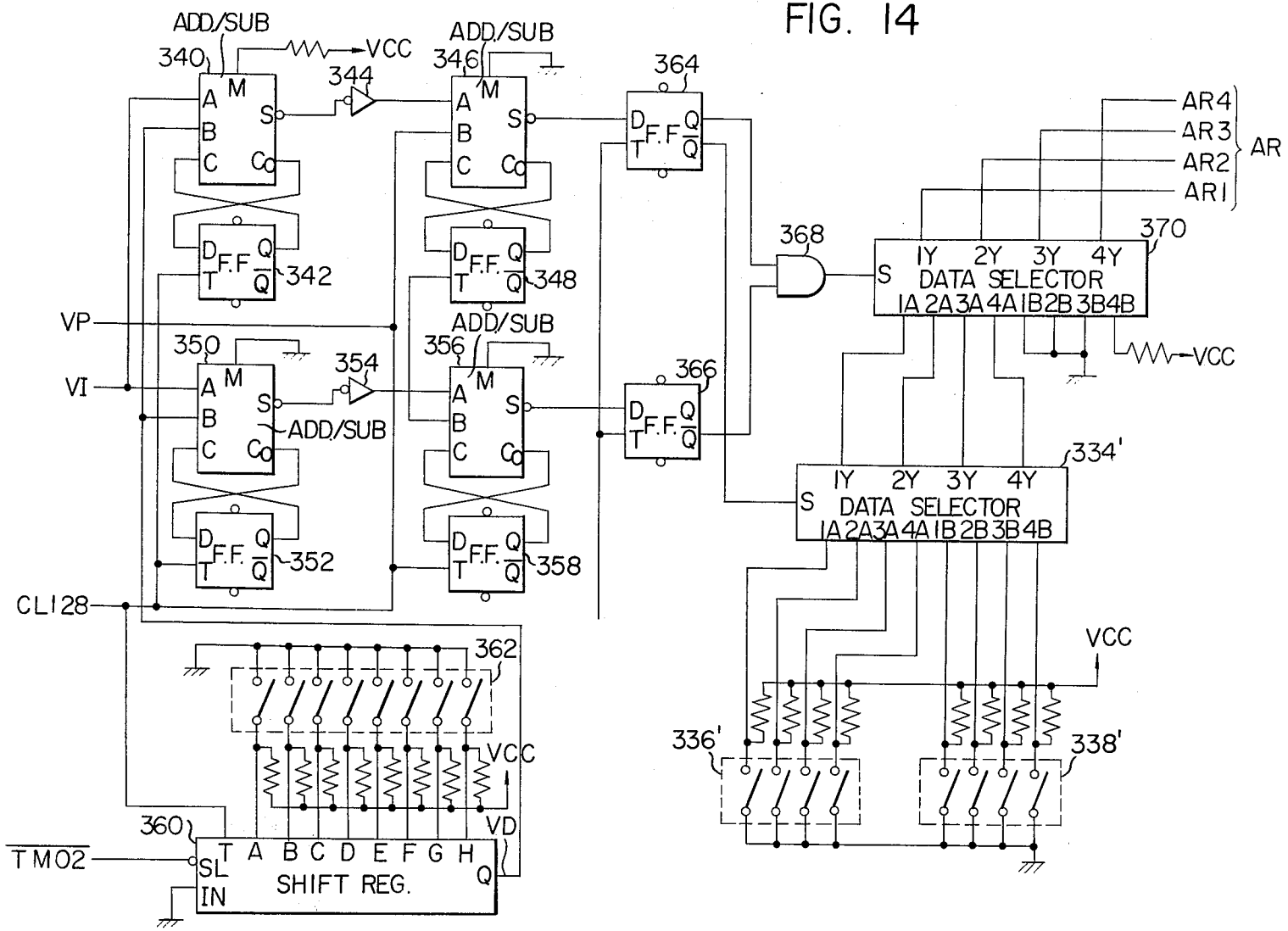
FIG. 14 is a circuit diagram of a modification of the speed comparator shown in FIG. 4.

FIG. 14 shows a modification of the speed comparator 40 shown in FIG. 4. In the arrangement illustrated the stored speed VI has a tolerance relative to the command speed VP and the speed is not corrected as long as a difference between the command and stored speeds VP and VI respectively is within the predetermined tolerance having a fixed value of VD. That is, the correction of the speed is smoothly effected by providing the so-called dead zone.

The arrangement comprises a series adder/subtracter circuit formed of an adder/subtracter 340 and a D FLIP-FLOP 342. The adder/subtracter 340 has an output S connected through an inverter 344 to an addition input A to an adder/subtracter 346 forming a similar series adder/subtracter circuit with a D FLIP-FLOP 348.

Similarly a series adder/subtracter circuit formed of an adder/subtracter 350 and a D FLIP-FLOP 352 is connected via an inverter 354 to an input A to a separate series adder/subtracter 356 forming a similar adder/-subtracter circuit with a D FLIP-FLOP 358. Those series adder/subtracter circuits are similar in construction and connection to the series adder/subtracter circuit formed of the adder/subtracter 80 and the D FLIP-FLOP 82 as above described in conjunction with FIG. 8. It is noted that only the adder/subtracter 340 includes a selection input M connected to the source VCC through a resistor to be at a level of binary ONE, and the selection inputs M of the remaining adder/subtracters are connected to ground to be at a level of binary ZERO.

The command speed signal VP is applied to the inputs B of the adder/subtracter's 346 and 356 and the stored speed signal VI is applied to the inputs A of the adder/subtracter's 340 and 350.

An 8-bit shift register 360 similar to the shift register 232 (see FIG. 11) is connected at the output Q to the inputs B of the adder/subtracter's 340 and 350, and includes eight parallel inputs A through H connected to a switch bank 362 similar to the switch bank 182 (see FIG. 10). The switch bank 362 preliminarily determines the tolerable speed difference VD. The shift register 360 further includes a clock input T applied with the basic operation clock pulse $\overline{CL128}$, a loading input SL applied with a timing signal $\overline{TM02}$ and another input IN connected to ground.

Thus the output Q of the shift register 360 delivers a speed signal VD in the same unit as the series command speed signal VP from the shift register 232 (see FIG. 11). This speed signal VD is to determine the dead zone connering the speed correction.

Because the input M thereof has a value of binary ONE the adder/subtracter 340 is operated to add the tolerable speed difference VD to the stored speed VI and delivers a signal for the sum of the VI and VD to the input A of the adder/subtracter 346 through the inverter 344. In the adder/subtracter 346 the selection input M has a value of binary ZERO and therefore a difference between that signal for the VI + VD and the command signal VP a is developed at the output S. If the signal VI + VD is greater than or equal to the command speed signal VP then the adder/subtracter 346 supplies to an edge trigger D FLIP-FLOP 364 a signal having a positive value including zero.

Under these circumstances, this positive signal has all the upper bit positions in the fundamental operating period are of binary ONE. By triggering the edge trigger D FLIP-FLOP 364 with a timing signal TM30 located in a time slot 30 of the fundamental operating period and applied to the a clock input T thereof and at its rise, the FLIP-FLOP 364 provide a binary ONE at the output Q and a binary ZERO at the output Q. On the contrary if VI − VD < VP, the adder/subtracter 346 produces at the output S, a negative signal having all the upper positions of the fundamental operating period put at the level of binary ZERO. As a result, the FLIP-FLOP 364 has a value of binary ZERO at the output Q and a value of binary ONE at the output $\overline{Q}$.

Since the selection inputs M of the adder/subtracter's 350 and 356 have the value of binary ZERO, the adder/substracter 350 provides a signal for VI−VD at the output S and the adder/subtracter 356 provides a signal for VI-VD-VP at the output S as will readily be understood from the foregoing description made in conjunction with the adder/subtracter's 340 and 346.

The output S of the adder/subtracter 356 is connected to an input D of an edge trigger D FLIP-FLOP 366 indentical to the FLIP-FLOP and including an output $\overline{Q}$ connected to one input to an AND gate 368. The AND gate 368 includes the other input connected to the output Q of the FLIP-FLOP 365 including the other output $\overline{Q}$ connected to the selection input S of a data selector 334' identical to the data selector 334 as above described in conjunction with FIG. 13. The A input of the data selector 334' have the 4-bit binary number $A_s$ as determined by the switch banck 336' and the B inputs thereof have the 4-bit binary number $A_L$ as determined by the switch banck 338' as above described.

When VI−VD ≧ VP, the FLIP-FLOP 336 has a binary ONE at the output Q and a binary ZERO at the output $\overline{Q}$. However when VI−VD < VP, it has a binary ZERO at the output Q and a binary ONE at the output $\overline{Q}$.

Therefore when VI + VP < VP, the output $\overline{Q}$ of the FLIP-FLOP 364 is of a binary ONE hence the AND gate 368 provides a binary ZERO at the output. As a result, the data selector 334' selects the 4-bit binary number $A_L$ which is, in turn applied to A inputs to a data selector 370 similar to the data selector 334'. The data selector 370 includes B inputs connected to ground excepting that the input 4B is connected to the source VCC through a resistor to have a binary number 1000 or a decimal number 8. Further the selector 370 includes a selection inputs connected to the output of the AND gate 368.

The binary zero at the output of the AND gate 368 causes the selector 370 to deliver the binary number $A_L$ to the rate multiplier 216 (see FIG. 10) as an accelerate rate signal AR having binary bits $AR_1$, $AR_2$, $AR_3$ and $AR_4$.

If $VI-VD < VP \leqq VI + VD$, both FLIp-FLOP's 364 and 366 have the respective outputs Q and $\overline{Q}$ put at the level of binary ONE. Therefore the AND gate 368 delivers an output of binary ONE to the data selector 370 to permit the latter to select a binary number 1000 or a decimal number 8 at the B inputs as the acceleration rate signal AR.

If $VI - VD \geqq VP$, both FLIP-FLOP's 364 and 366 have the respective outputs $\overline{Q}$ and $\overline{Q}$ put at the level of binary ZERO to produce a binary ZERO at the output of the AND 368. Under these circumstance, the data selector 370 selects, as an acceleration rate signal AR, the binary number $A_s$ less than the central value of 4-bit binary numbers.

From the foregoing it is seen that, if the command speed VP is within the magnitude of the speed VD as predetermined about the stored speed VI indicating the ideal speed that the speed correction due to a change in acceleration is not effected thereby to permit the command speed VP to smoothly follow up the ideal speed VI.

Figure 15:
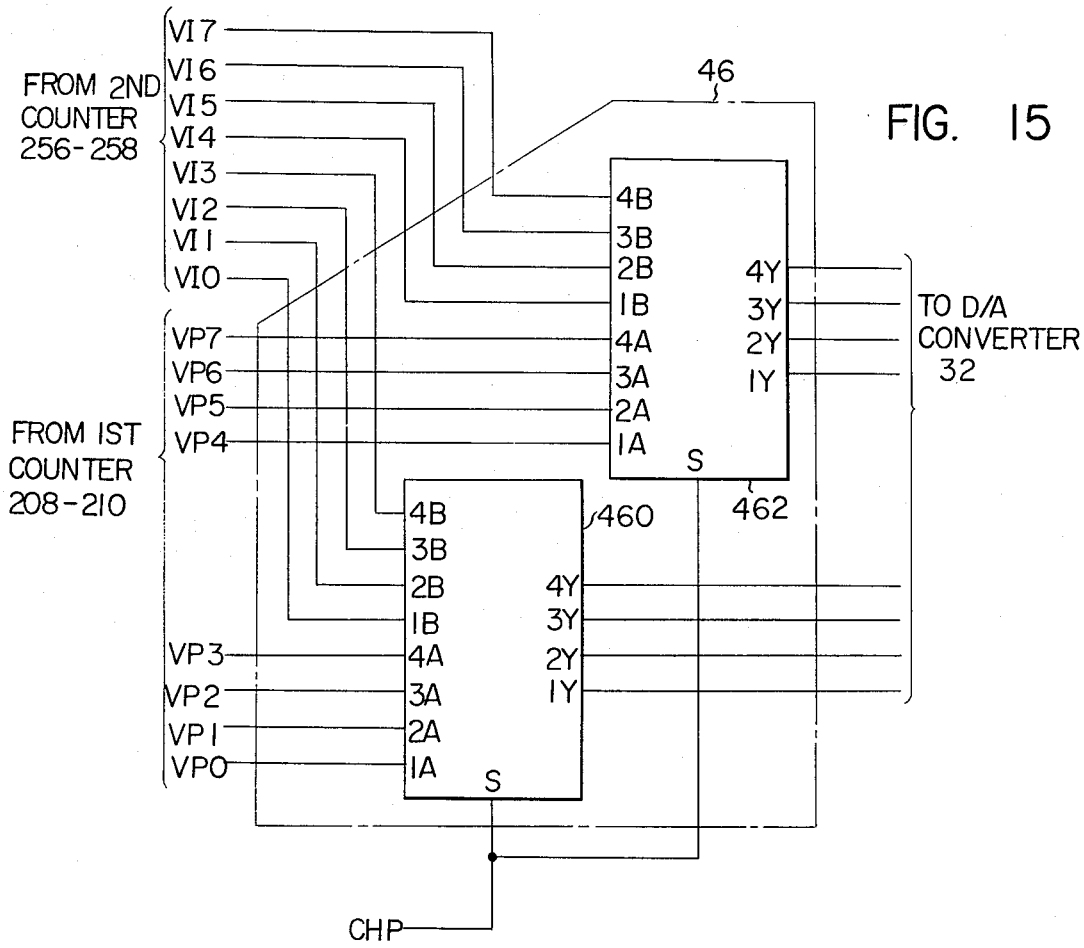
FIG. 15 is a circuit diagram of a modification of the command speed selector arrangement shown in FIG. 5.

According to the present invention, the command speed during the deceleration may be formed of the ideal speed pattern during the deceleration as stored in memory during the acceleration as above described in conjunction with FIG. 5. The command speed selector 46 shown in FIG. 5 may be of a circuit configuration as illustrated in FIG. 15. The arrangement illustrated comprises a pair of data selectors 460 and 462 similar to the data selector 188 as shown in FIG. 10. Each data selector 460 or 462 is responsive to a value of binary ZERO at the selection input S thereof to select bits VP0, VP1, VP2 and VP3 or VP4, VP5, VP6 and VP7 of the command signal VP applied to the inputs 1A, 2A. 3A and 4A thereof from the counter 208 and 210 of the first counter device 28 to supply them to the corresponding inputs of to the digital-to-analog converter 32 through the outputs 1Y, 2Y, 3Y and 4Y thereof. It is also responsive to a value of binary ONE at the selection input S to similarly supply bits VIo, VI1, VI2 and VI3 or VI4, VI5, VI6 and VI7 applied to the inputs 1B, 2B, 3B and 4B thereof from the counters 256 and 258 of the second counter device 38 to the digital-to-analog converter 32.

Referring back to FIG. 13, the magnitude comparator 332 is shown as having the output A = B connected to both an input to a master-slave JK FLIP-FLOP 464 such as marketed under TTL-IC SN7423 7474 by Texas Instruments Incorp. and one input to NAND gate 466. The FLIP-FLOP 464 includes an input J connected to the source VCC, an input K connected to ground and an output Q connected to the other input to the NAND gate 466. Further status-of-operation signal STO is applied to an reset input R to the FLIP-FLOP 464 through an inverter 468.

The NAND gate 466 includes an output connected to one input to a NAND gate 470 including the other input connected to an output of another NAND gate 472. The NAND gate 470 includes an output connected to one input to the NAND gate 472 including the other input applied with the status-of-operation signal STO through the inverter 468.

In FIG. 13, it is seen that the FLIP-FLOP 464 includes the input J having a vlaue of binary ONE and the input K having a value of binary ZERO.

During the stop of an associated elevator car the status-of-operation signal STO is applied to a FLIP-FLOP circuit formed of the master-slave JK FLIP-FLOP 466 and the NAND gates 470 and 472 to reset it. Therefore the output of the NAND gate 470 provides a choice signal CHP of binary ZERO.

After the start of the car, the command speed VP becomes first equal to the stored speed VI at the time point $T_p$ (see FIG. 6), whereupon the output A = B of the data comparator 332 changes from a value of binary ZERO to a value of binary ONE. However the output Q of the FLIP-FLOP 464 remains at a value of binary ZERO until the output A = B of the data comparator 332 changes from a value of binary ONE to a value of binary ZERO. Thus the output of the NAND gate 466 does not change to a value of binary ZERO. Then the command speed VP will be again equal to the stored speed VI to deliver a value of binary ONE from the output A = B of the data comparator 332. This causes the NAND gate 466 to deliver a value of binary ZERO from the output thereof because the output Q of the FLIP-FLOP 464 has been already put at a value of binary ONE. Thus a FLIP-FLOP circuit formed of the NAND gates 470 and 472 is set to provide a value of a binary ONE at the output of the gate 470. Therefore the choice signal CHP that is the output from the NAND gate 470 is maintained at a value of binary ONE until the FLIP-FLOP circuit is reset with the status-of-operation signal STO upon the stop of the car.

As shown in FIG. 15 that choice signal CHP is applied to the selection inputs S of the data comparators 460 and 462.

From the foregoing it is seen that the data selectors 460 and 462 first select the command speed signal from the first counter 208–210 expressed by the bits VPO through VP7 because the selection input S thereof is applied with the choice signal CHP having a value of binary ZERO. However, upon the command speed VP again equalling the stored speed VI and thereafter the data selectors 460 and 462 select the second or stored speed VI from the second counter 256–258 expressed by the bits VI0 through VI7.

Therefore the stored speed VI left intact serves as the command speed during the deceleration.

From the foregoing it is seen that the present invention comprises storing a second speed pattern concerning ideal distances of movement due to a command speed pattern during the acceleration as a distance-to-speed function and utilizing the stored second speed pattern for producing a command speed pattern during the deceleration. Therefore the command speed pattern during the deceleration can follow up an ideal command speed pattern with respect to a residual distances to a desired stop position.

Therefore complicated calculations concerning time delays intrinsic to the control system, the turn around positions of the speed pattern etc. can be avoided by generating a speed pattern for the particular elevator car identical in shape to and delayed a predetermined time interval with respect to a command speed pattern for the car and storing the speed pattern concerning theoretical distances of movement of the car due to the command speeds during the acceleration. This results in a speed pattern on the basis of precise distances with a simplified circuit configuration.

While the present invention has been illustrated and described in conjunction with a few preferred embodiments thereof it is to be understood that numerous changes and modifications may be reported to without departing from the spirit and scope of the present invention.

What we claim is:

1. An elevator speed control system comprising, in combination, first speed pattern generator means for generating a command speed pattern, second speed pattern generator means for generating a second speed pattern delayed a predetermined time interval with respect to said command speed pattern during the acceleration, distance-of-movement calculating means for calculating theoretical distances of movement due to said command speed pattern, memory means for writing and reading said calculated theoretical distances of movement into and out from the same, said memory means successively storing said second speed pattern concerning said theoretical distances of movement in the form of a distance-to-speed function during the acceleration, and means for utilizing said second speed pattern stored in said memory means to generate a command deceleration pattern during the deceleration.

2. An elevator speed control system as claimed in claim 1 wherein at and after a time point where said second speed pattern is first equal to said command speed pattern, a command speed pattern is generated while an acceleration is modified so that the last-mentined command speed pattern follows up objectives of command speeds concerning residual distances to an objective position, said objectives of command speeds being provided by said distance-to-speed function stored in said memory means during the acceleration.

3. An elevator speed control system as claimed in claim 1 wherein at and after a time point where said second speed pattern is first equal to said command speed pattern, said distance-to-speed function stored in said memory means during the acceleration is used as said command deceleration pattern concerning residual distances to an objective position.

4. An elevator speed control system as claimed in claim 1 wherein at and after a time point where said second speed pattern is first equal to said command speed pattern, a command speed pattern is generated while an acceleration is modified so that the last mentioned command speed pattern follows up objectives of command speeds concerning residual distances to an objective position, said objectives of command speeds being provided by said distance-to-speed function stored in said memory means during the acceleration, and wherein once said command speeds is equal to said objectives, said distance-to-speed function left intact is used as said command deceleration pattern concerning said residual distances to the objective position.

5. An elevator speed control system as claimed in claim 1 wherein there is provided speed comparator means operative in response to a difference between said command speed pattern and said second speed pattern in excess of a predetermined magnitude and having a dead zone for speeds.

6. An elevator speed control system comprising, in combination, an elevator car, a first speed pattern generator means for generating a command speed pattern, second speed pattern generator means for generating a second speed pattern delayed a predetermining time interval with respect to said command speed pattern during the acceleration, distance-of-movement calculation means for calculating theoretical distances of movement due to said command speed pattern, memory means for writing and reading said calculated theoretical distances of movement into and out from the same, position-to-speed converted means for generating a speed pattern dependent upon a position of said elevator car immediately prior to the landing thereof, distance corrector means for correcting said theoretical distances of movement by predetermined distances respectively, said memory means successively storing said second speed pattern concerning said theoretical distances of movement corrected by said distance corrector means in the form of a distance-to-speed function during the acceleration, means for utilizing said second speed pattern stored in said memory means to generate a command deceleration pattern during the deceleration, and means for smoothly changing said command speed pattern to said speed pattern provided by said position-to-speed converter means.

7. An elevator speed control system as claimed in claim 6 wherein there is provided speed comparator means operative in response to a difference between said command speed pattern and said second speed pattern in excess of a predetermined magnitude and having a deal zone concerning a speed.

* * * * *